US011774059B2

(12) United States Patent
Ko et al.

(10) Patent No.: US 11,774,059 B2
(45) Date of Patent: Oct. 3, 2023

(54) LAMP FOR VEHICLE

(71) Applicant: SL Corporation, Daegu (KR)

(72) Inventors: Dongjin Ko, Gyeongsan-si (KR); Changwoo Baek, Gyeongsan-si (KR); Jaegon Seo, Gyeongsan-si (KR); Jin-Sup Shin, Gyeongsan-si (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 17/993,159

(22) Filed: Nov. 23, 2022

(65) Prior Publication Data

US 2023/0204179 A1 Jun. 29, 2023

(30) Foreign Application Priority Data

Dec. 29, 2021 (KR) ..... 10-2021-0191200

(51) Int. Cl.
*F21S 41/65* (2018.01)
*F21S 41/36* (2018.01)
*F21W 102/13* (2018.01)

(52) U.S. Cl.
CPC ..... *F21S 41/65* (2018.01); *F21S 41/36* (2018.01); *F21W 2102/13* (2018.01)

(58) Field of Classification Search
CPC ..... F21S 41/36; F21S 41/65
See application file for complete search history.

(56) References Cited

U.S. PATENT DOCUMENTS

| | | | | |
|---|---|---|---|---|
| 2015/0211703 | A1* | 7/2015 | Nakazawa | F21S 41/365 362/520 |
| 2015/0219302 | A1* | 8/2015 | Yagi | F21S 41/689 362/520 |
| 2017/0067613 | A1* | 3/2017 | Mouri | F21S 41/39 |
| 2017/0136939 | A1* | 5/2017 | Mouri | B60Q 1/076 |
| 2017/0158112 | A1* | 6/2017 | Mouri | F21S 41/675 |
| 2017/0160542 | A1* | 6/2017 | Mouri | G02B 27/0006 |
| 2018/0099604 | A1* | 4/2018 | Mouri | B60Q 9/008 |
| 2018/0106455 | A1* | 4/2018 | Uchida | F21S 41/675 |
| 2019/0116345 | A1* | 4/2019 | Albou | F21S 41/675 |
| 2021/0231286 | A1* | 7/2021 | Nakanishi | F21S 41/143 |
| 2022/0001790 | A1* | 1/2022 | Mochizuki | F21S 41/67 |

FOREIGN PATENT DOCUMENTS

| | | | | |
|---|---|---|---|---|
| JP | 2016091976 | * | 5/2016 | F21S 41/147 |

* cited by examiner

*Primary Examiner* — Zheng Song
(74) *Attorney, Agent, or Firm* — United One Law Group LLC; Kongsik Kim; Jhongwoo Peck

(57) ABSTRACT

A lamp for a vehicle using micromirrors includes a variable beam forming part that generates light and forms a variable beam pattern. In particular, the variable beam forming part includes a first optical part that irradiates the light; a beam pattern forming part that reflects the light of the first optical part to form the variable beam pattern; and a second optical part that transmits the light reflected from the beam pattern forming part. The beam pattern forming part includes a reflection part including a plurality of micromirrors; and a housing that accommodates the reflection part. The housing includes an anti-reflection member to prevent secondary reflection of the light having been reflected by the reflection part.

9 Claims, 30 Drawing Sheets

13

LAMP FOR VEHICLE

CROSS-REFERENCE TO RELATED APPLICATION

This application claims priority from Korean Patent Application No. 10-2021-0191200 filed on Dec. 29, 2021, which is incorporated herein by reference in its entirety.

BACKGROUND

1. Technical Field

The present disclosure relates to a lamp for a vehicle, and more particularly, to a lamp for a vehicle using micromirrors.

2. Description of the Related Art

In general, a vehicle is equipped with one or more lamps that provide illumination function for easily identifying objects around the vehicle during low-light conditions (e.g., night-time driving) and signaling function for informing other vehicles or road users of its driving condition.

For instance, the vehicle may be equipped with a vehicle lamp that operates by direct luminescence using lamps, such as, a headlamp that irradiates the light toward the front to secure a driver's field of view, a brake light that is turned on when the brake is applied, and a direction indicator that is used when the vehicle turns right or left. In addition, the front and rear of the vehicle may be provided with reflectors that reflect light so that the vehicle can be easily recognized from outside.

Among them, the headlamp has an essential function to secure the driver's view by irradiating light in substantially the same direction as the driving direction of the vehicle when the vehicle is operated in low ambient brightness (e.g., at night or in a tunnel).

On the other hand, as the driver is looking ahead, it is not easy to provide specific information to the driver through the dashboard.

Therefore, there is a need for a means that provides information at night to a driver who is looking ahead.

SUMMARY

Aspects of the present disclosure provide a lamp for a vehicle using micromirrors. The technical aspects of the present disclosure are not restricted to those set forth herein, and other technical aspects will be clearly understood by one of ordinary skill in the art to which the present disclosure pertains by referencing the detailed description of the present disclosure provided below.

In order to achieve the above object, a lamp for a vehicle according to an embodiment of the present disclosure may include a variable beam forming part configured to irradiate light and form a variable beam pattern. In particular, the variable beam forming part may include a first optical part configured to generate the light; a beam pattern forming part configured to reflect the light of the first optical part to form the variable beam pattern; and a second optical part configured to transmit the light reflected from the beam pattern forming part. Further, the beam pattern forming part may include a reflection part including a plurality of micromirrors; and a housing configured to accommodate the reflection part, and the housing may include an anti-reflection member configured to prevent secondary reflection of the light reflected by the reflection part.

The housing may include an auxiliary housing configured to support the second optical part and prevent light that is not incident on the second optical part from being emitted to outside, among the light reflected by the reflection part.

The anti-reflection member may absorb or diffuse incident light. In particular, the anti-reflection member may include a first light diffusion part formed on an inner bottom surface of the auxiliary housing and configured to diffuse incident light. The first light diffusion part may include a hemispherical convex surface and a hemispherical concave surface.

The housing may include a light transmitting plate sealed by the auxiliary housing and disposed between the reflecting part and the second optical part, and the light transmitting plate may include a light transmitting aperture configured to transmit the light reflected by the reflecting part. Further, the anti-reflection member may include a second light diffusion part formed on a surface of the light transmitting plate that faces the second optical part to diffuse incident light. Further, the second light diffusion part may include semicircular pillar-shaped convex and concave surfaces elongated in a vertical direction. However, no second light diffusion part may be formed in at least a portion of an edge of the light transmitting aperture on a surface of the light transmitting plate.

The auxiliary housing may include a light transmitting aperture, to which the second optical part is coupled, to transmit light to be incident on the second optical part, and the anti-reflection member may include a third light diffusion part formed on an inner surface of the auxiliary housing adjacent to the light transmitting aperture and configured to diffuse incident light. The third light diffusion part may include semicircular pillar-shaped convex and concave surfaces elongated in a vertical direction.

According to a lamp for a vehicle according to embodiments of the present disclosure, there is an advantage of enabling safer driving as information is projected forward using micromirrors.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION

Figure 1:
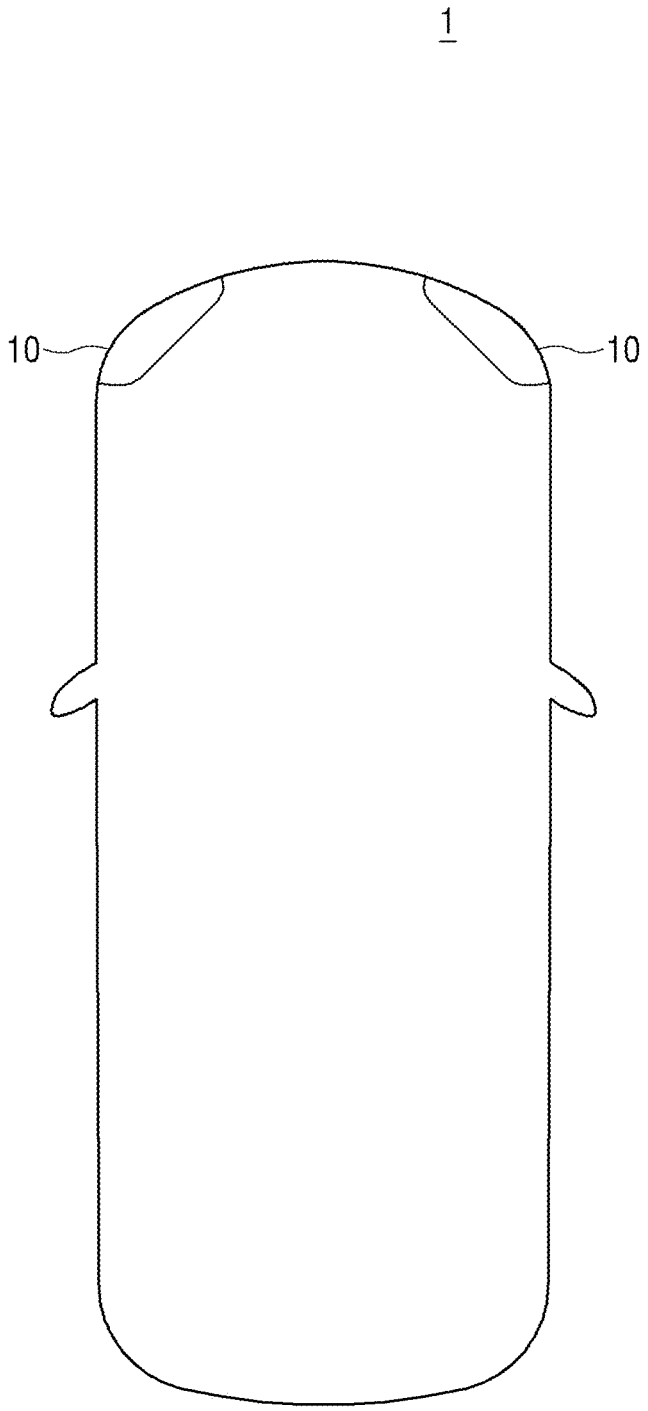
FIG. 1 illustrates a vehicle including a lamp for a vehicle.

Hereinafter, exemplary embodiments of the present disclosure will be described in detail with reference to the accompanying drawings. Advantages and features of the present disclosure, and a method of achieving them will be apparent with reference to the embodiments described below in detail together with the accompanying drawings. However, the present disclosure is not limited to the embodiments to be described below, but may be implemented in various different forms, and these embodiments are only provided to make the disclosures complete, and to fully inform the scope of the disclosure to those of ordinary skill in the technical field to which the present disclosure belongs. The invention is only defined by the scope of the claims. The same reference numerals refer to the same components throughout the specification.

Unless otherwise defined, all terms (including technical and scientific terms) used in the present specification may be used as meanings that can be commonly understood by those of ordinary skill in the art to which the present disclosure belongs. In addition, terms defined in a commonly used dictionary are not to be interpreted too ideally or excessively unless explicitly defined.

FIG. 1 illustrates a vehicle including a lamp for a vehicle. Referring to FIG. 1, a vehicle 1 may include a lamp 10. In an embodiment of the present disclosure, the lamps 10 for a vehicle may be installed on both sides of the front of the vehicle 1 to secure a front view when the vehicle 1 operates in low-light conditions (e.g., at night or in a dark place such as a tunnel). Accordingly, a case where the lamp 10 for a vehicle is used as the head lamp will be mainly described. However, this is only an example to help understand the present disclosure. The lamp 10 for a vehicle of the present disclosure is not limited to the head lamp, and may be used for various lamps installed in the vehicle 1, such as a fog lamp, a tail lamp, a brake lamp, a turn signal lamp, a position lamp, and a daytime running lamp.

The lamp 10 for a vehicle may form a low beam pattern to secure a short-range view in front of the vehicle 1, and a high beam pattern HP (see FIG. 5) to secure a long-distance view in front of the vehicle 1. In forming the high beam pattern HP, the lamp 10 for a vehicle may form a shadow area by preventing light from being irradiated or reducing the amount of light irradiated to an area that corresponds to the position of an on-coming vehicle or a preceding vehicle. With the formation of the shadow area, glare may be prevented or reduced to the driver of the on-coming vehicle.

The lamp 10 for a vehicle may include a first vehicle lamp 10 provided on the front left side of the vehicle 1 and a second vehicle lamp 10 provided on the front right side of the vehicle 1. In other words, the first vehicle lamp 10 may be understood as a left head lamp, and the second vehicle lamp 10 may be understood as a right head lamp.

In an embodiment of the present disclosure, a case in which a plurality of vehicle lamps 10 are provided is described as an example since the vehicle lamp 10 of the present disclosure is used as the head lamp. However, the number of the vehicle lamps 10 of the present disclosure is not limited thereto. In other words, the number, installation position, and installation direction of light irradiation parts may be variously changed based on the purpose of the vehicle lamp 10 of the present disclosure.

Figure 2:
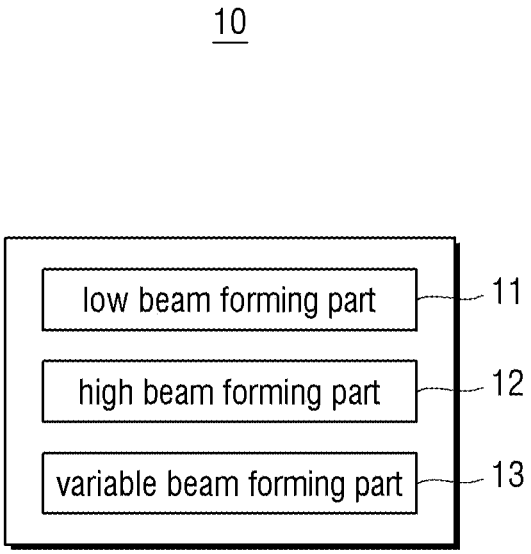
FIG. 2 is a block diagram of the lamp for a vehicle according to an embodiment of the present disclosure.

FIG. 2 is a block diagram of the lamp for a vehicle according to an embodiment of the present disclosure. Referring to FIG. 2, the lamp 10 for a vehicle may include a low beam forming part 11, a high beam forming part 12, and a variable beam forming part 13.

The low beam forming part 11 may irradiate light to form the low beam pattern LP (see FIG. 3), and the high beam forming part 12 may irradiate light to form the high beam pattern HP. In order to form the low beam pattern LP and the high beam pattern HP, each of the low beam forming part 11 and the high beam forming part 12 may include a light source and at least one of a reflector or a lens.

Figure 7:
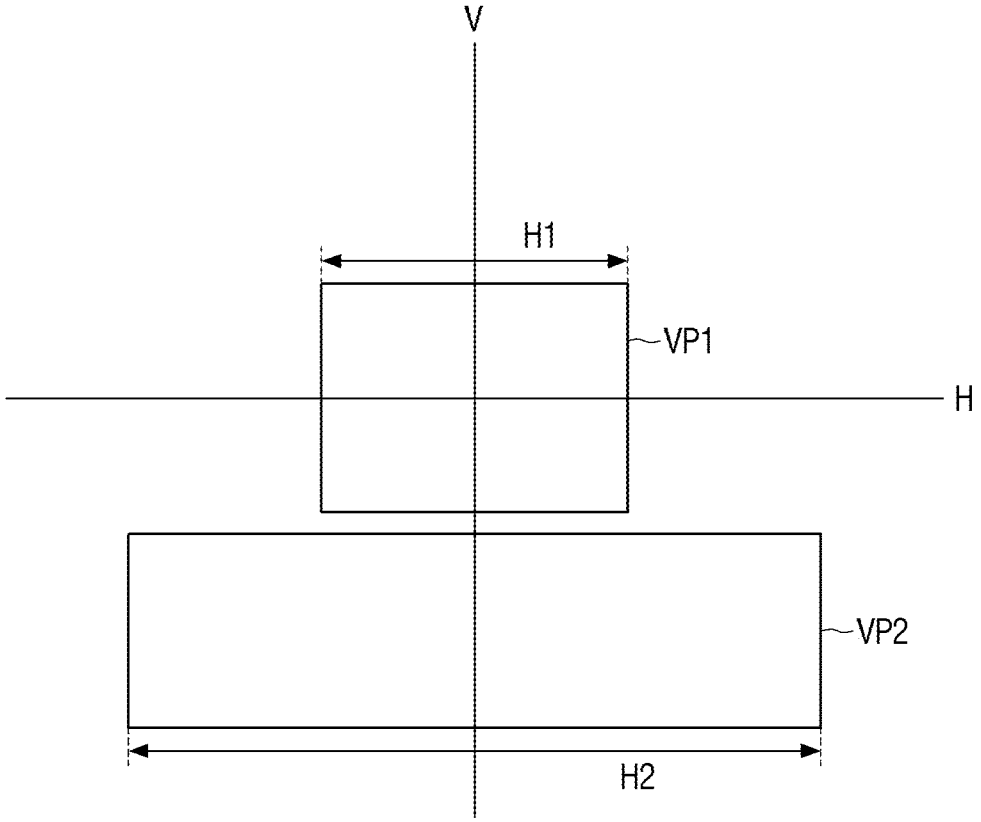
FIG. 7 illustrates a variable beam pattern formed by a variable beam forming part.

The variable beam forming part 13 may irradiate light to form variable beam patterns VP1 and VP2 (see FIG. 7). In the present disclosure, the variable beam patterns VP1 and VP2 may represent a beam pattern whose shape may be variously modified. For instance, light may be irradiated to some portions of the formation surfaces of the beam pattern, and no other portions of the formation surfaces. The area where light is irradiated and the area where no light is irradiated may be flexibly determined over time. When using the variable beam patterns VP1 and VP2, informational images such as letters, numbers, or symbols may be formed on the formation surface of the beam pattern.

Figure 3:
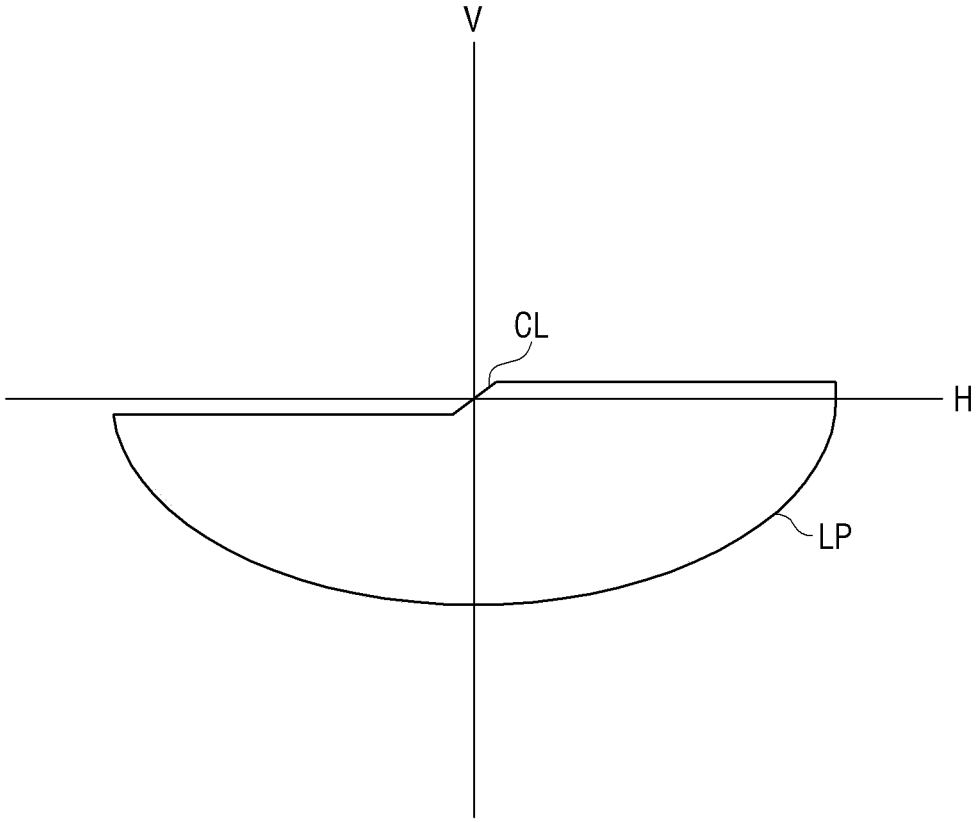
FIG. 3 illustrates a low beam pattern formed by a low beam forming part.
Figure 4:
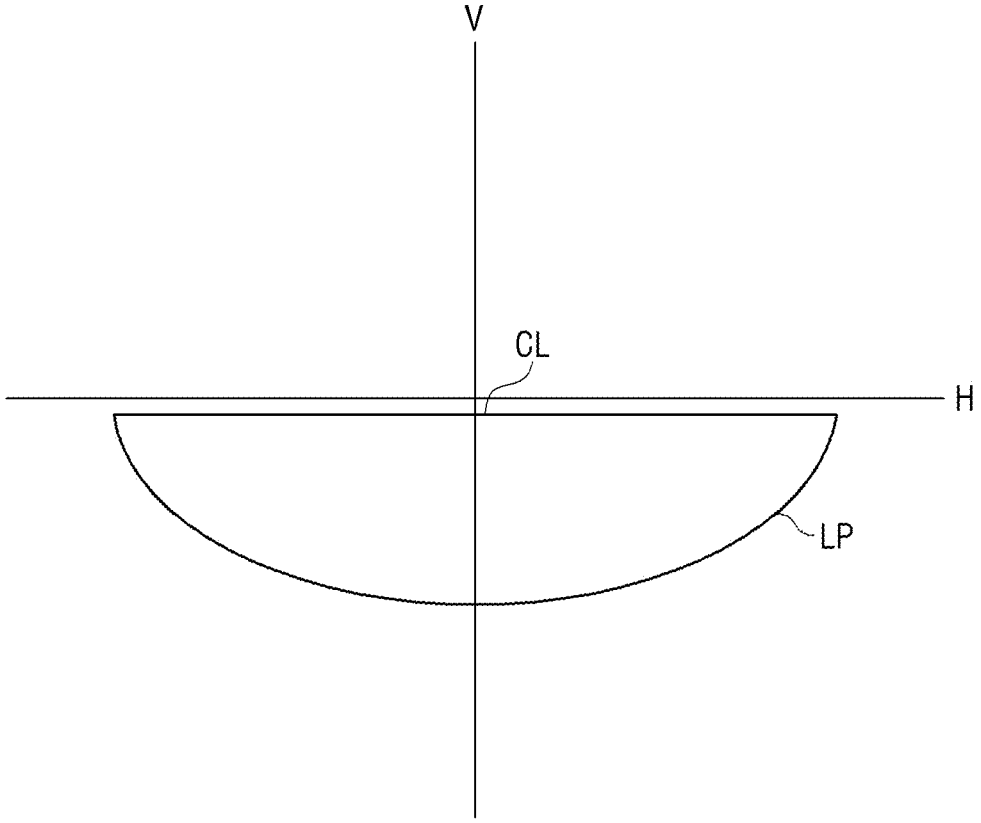
FIG. 4 illustrates a low beam pattern that includes a linear cut-off line.
Figure 5:
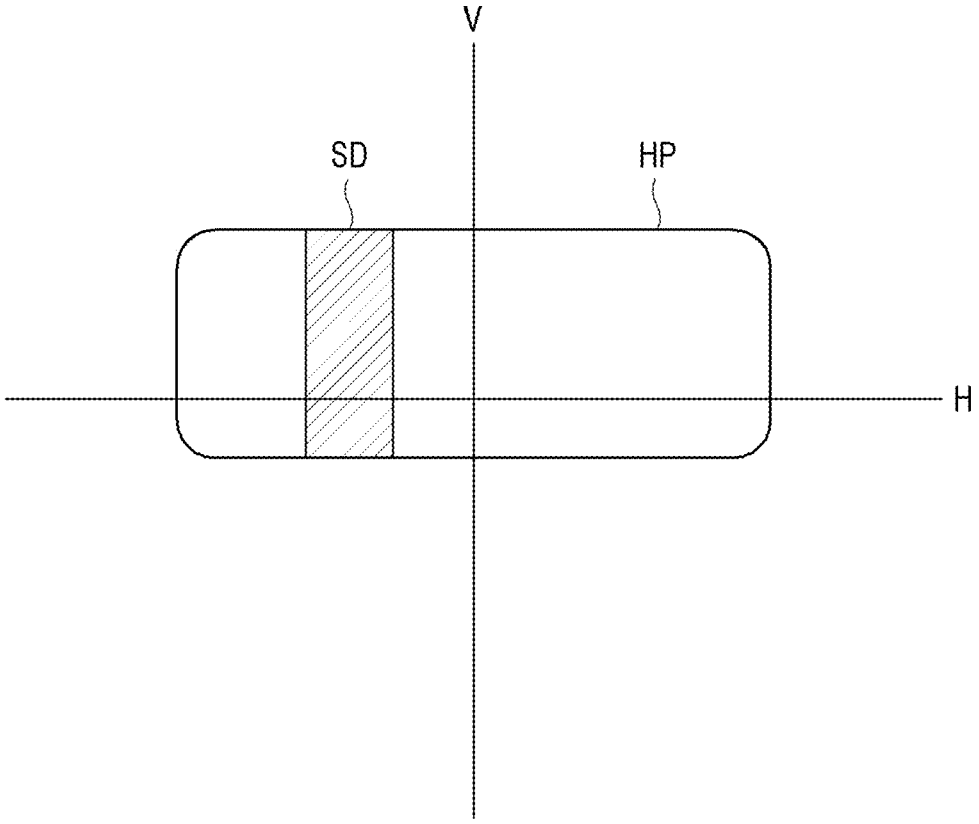
FIG. 5 illustrates a high beam pattern formed by a high beam forming part.
Figure 6:
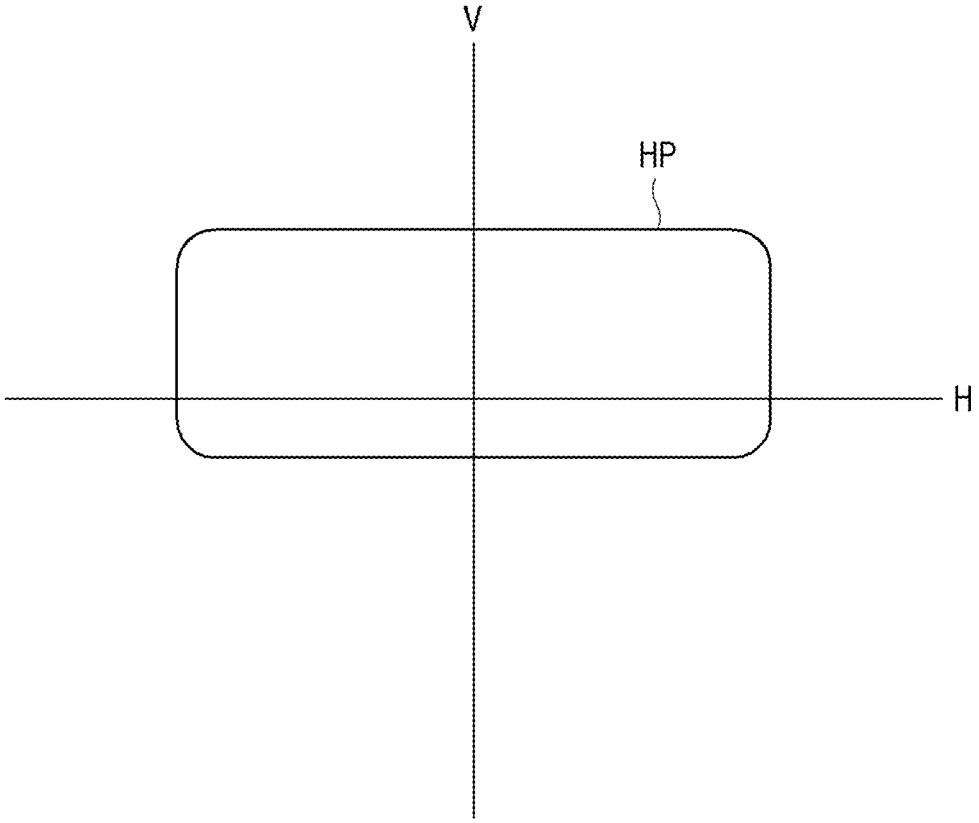
FIG. 6 illustrates a high beam pattern that does not include a shadow area.
Figure 8:
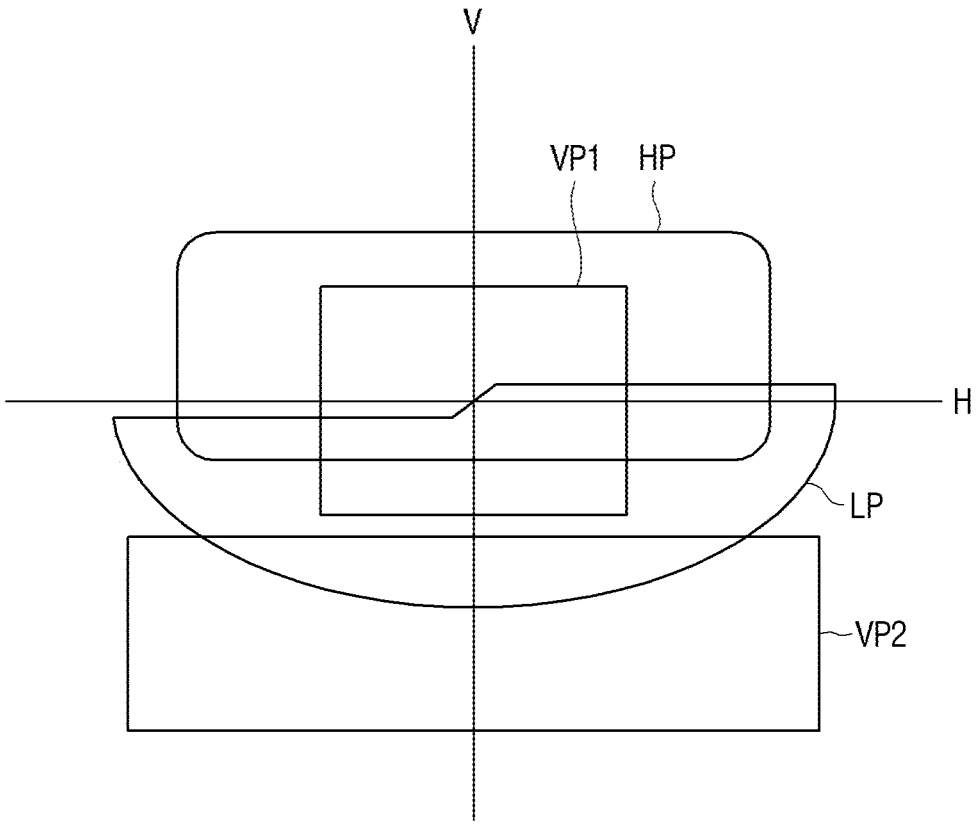
FIG. 8 illustrates a low beam pattern and a high beam pattern.

FIG. 3 illustrates the low beam pattern formed by the low beam forming part, FIG. 4 illustrates the low beam pattern including a linear cut-off line, FIG. 5 illustrates the high beam pattern formed by the high beam forming part, FIG. 6 illustrates the high beam pattern without a shadow area, FIG. 7 illustrates the variable beam pattern formed by the variable beam forming part, and FIG. 8 illustrates the low beam pattern and the high beam pattern.

Referring to FIG. 3, the low beam pattern LP may include a cut-off line CL. The cut-off line CL may include an inclined portion that crosses the center of the beam pattern formation surface. The left and right sides of the low beam pattern LP may have different heights with respect to the inclined portion. The low beam pattern LP may be formed in a relatively short-range in front of the vehicle 1 to secure a short-range front view.

Meanwhile, according to another embodiment of the present disclosure, as illustrated in FIG. 4, the low beam pattern LP may include a substantially linear cut-off line CL. In such case, the left and right sides of the low beam pattern LP may have the same height. The shape of the cut-off line CL may be determined pursuant to national and/or local regulations. Hereinafter, the low beam pattern LP including a cut-off line CL with an inclined line, such as shown in FIG. 3, will be mainly described.

Referring to FIG. 5, the high beam pattern HP may selectively include a shadow area SD. The shadow area SD may represent an area in which substantially no light is irradiated. For instance, when another vehicle is disposed ahead, the high beam pattern HP may include the shadow area SD to prevent light from being irradiated to the corresponding area. The position and/or the number of the shadow area SD within the entire high beam pattern HP may be varied.

The arrangement of the shadow area within the high beam pattern HP may be performed by a separate control device. The control device may be configured to control the high beam forming part 12 to irradiate light based on the surrounding environment, and the high beam forming part 12 may form the high beam pattern HP in accordance with control instructions of the control device.

The high beam pattern HP may be formed in a relatively long-distance in front of the vehicle 1 to secure a long-distance front view. For instance, the high beam pattern HP may be formed farther from the vehicle 1 than the low beam pattern LP.

Meanwhile, according to another embodiment of the present disclosure, as illustrated in FIG. 6, the high beam pattern HP may include no shadow area. In such case, substantially uniform light may be formed over the entire high beam pattern HP.

Referring to FIG. 7, the variable beam patterns VP1 and VP2 may include a first variable beam pattern VP1 and a second variable beam pattern VP2. The first variable beam pattern VP1 may correspond to a region having a predetermined size including the center of the beam pattern formation surface. The center of the first variable beam pattern VP1 may coincide with the center of the beam pattern formation surface, or may be spaced apart from the center of the beam pattern formation surface by a predetermined distance.

Similarly to the first variable beam pattern VP1, the second variable beam pattern VP2 may correspond to a region having a predetermined size formed in a particular position on the beam pattern formation surface.

Areas occupied by each of the first variable beam pattern VP1 and the second variable beam pattern VP2 may be provided, for instance, in a rectangular shape. However, the shape of the first variable beam pattern VP1 and the second variable beam pattern VP2 of the present disclosure is not limited to the rectangular shape, and may be provided in shapes other than the rectangular shape (e.g., a polygonal shape, an elliptical shape, or any other geometric shape). Hereinafter, the first variable beam pattern VP1 and the second variable beam pattern VP2 that form a substantially rectangular shape will be mainly described.

The area of the second variable beam pattern VP2 may be greater than the area of the first variable beam pattern VP1. Specifically, a horizontal length H2 of the second variable beam pattern VP2 may be greater than a horizontal length H1 of the first variable beam pattern VP1. Since the first variable beam pattern VP1 is irradiated to a longer distance from the vehicle 1 than the second variable beam pattern VP2, both the short-distance and the long-distance front view may be improved over a wide area as the first variable beam pattern may diffuse even though it is irradiated with a relatively narrower area. Meanwhile, the second variable beam pattern VP2 may be irradiated to a shorter distance from the vehicle 1 than the first variable beam pattern VP1.

A predetermined interval may be formed between the first variable beam pattern VP1 and the second variable beam pattern VP2. In other words, the first variable beam pattern VP1 and the second variable beam pattern VP2 may not overlap each other. In the present disclosure, the first variable beam pattern VP1 and the second variable beam pattern VP2 may not be formed concurrently. For instance, when the first variable beam pattern VP1 is formed, the second variable beam pattern VP2 may not be formed, and when the second variable beam pattern VP2 is formed, the first variable beam pattern VP1 may not be formed.

Referring to FIG. 8, the variable beam patterns VP1 and VP2 may overlap with the low beam pattern LP and the high beam pattern HP. As described above, the first variable beam pattern VP1 may be formed in the center of the beam pattern formation surface or may be disposed adjacent to the center thereof. For example, the first variable beam pattern VP1 may be formed above the second variable beam pattern VP2 and may be included in the areas of the low beam pattern LP and the high beam pattern HP. Accordingly, the first variable beam pattern VP1 may be formed farther than the second variable beam pattern VP2 and may increase the brightness of a corresponding portion by assisting the low beam pattern LP or the high beam pattern HP. A short-distance or long-distance front view may be further improved due to the first variable beam pattern VP1.

In addition, the first variable beam pattern VP1 may include a road surface pattern to provide driving information to the driver. For instance, in the first variable beam pattern VP1, driving information such as a driving direction, driving speed, or traffic information may be formed on the road surface in the form of an image such as a letter, a number, a symbol, or any combination thereof.

Similarly to the first variable beam pattern VP1, the second variable beam pattern VP2 may include a road surface pattern to provide driving information to the driver. For instance, in the second variable beam pattern VP2, driving information such as a driving direction, driving speed, or traffic information may be formed on the road surface in the form of an image such as a letter, a number, a symbol, or any combination thereof.

In addition, the second variable beam pattern VP2 may include a road surface pattern to provide information associated with welcoming (e.g., "welcome") or farewell (e.g., "goodbye"). For example, when the driver approaches or moves away from the vehicle 1, the second variable beam pattern VP2 may be formed on the road surface, which includes a light pattern, an image, or a text that means a welcoming or farewell sign to the driver.

The second variable beam pattern VP2 may be formed closer to the vehicle 1 than the low beam pattern LP. For example, the second variable beam pattern VP2 may be formed within 3 to 10 meters in front of the vehicle 1.

According to some embodiments of the present disclosure, the second variable beam pattern VP2 may include a road surface pattern to provide information different from the road surface pattern of the first variable beam pattern VP1. For instance, when the first variable beam pattern VP1 includes the driving information of the vehicle, the second variable beam pattern VP2 may include information that is different and unrelated to the driving information of the vehicle or may include information that is different and related to the driving information of the vehicle.

Figure 9:
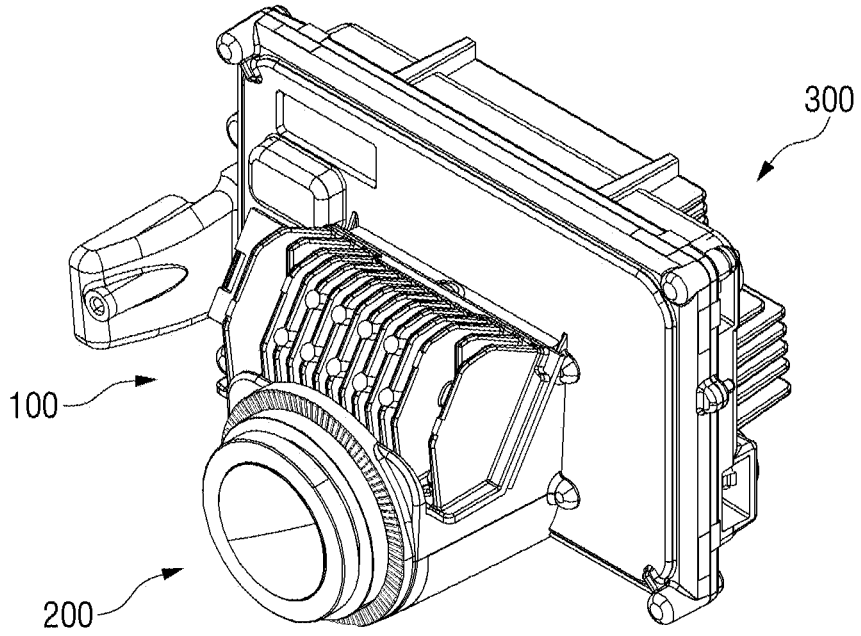
FIG. 9 is a perspective view of the variable beam forming part of the lamp for vehicle according to an embodiment of the present disclosure.
Figure 10:
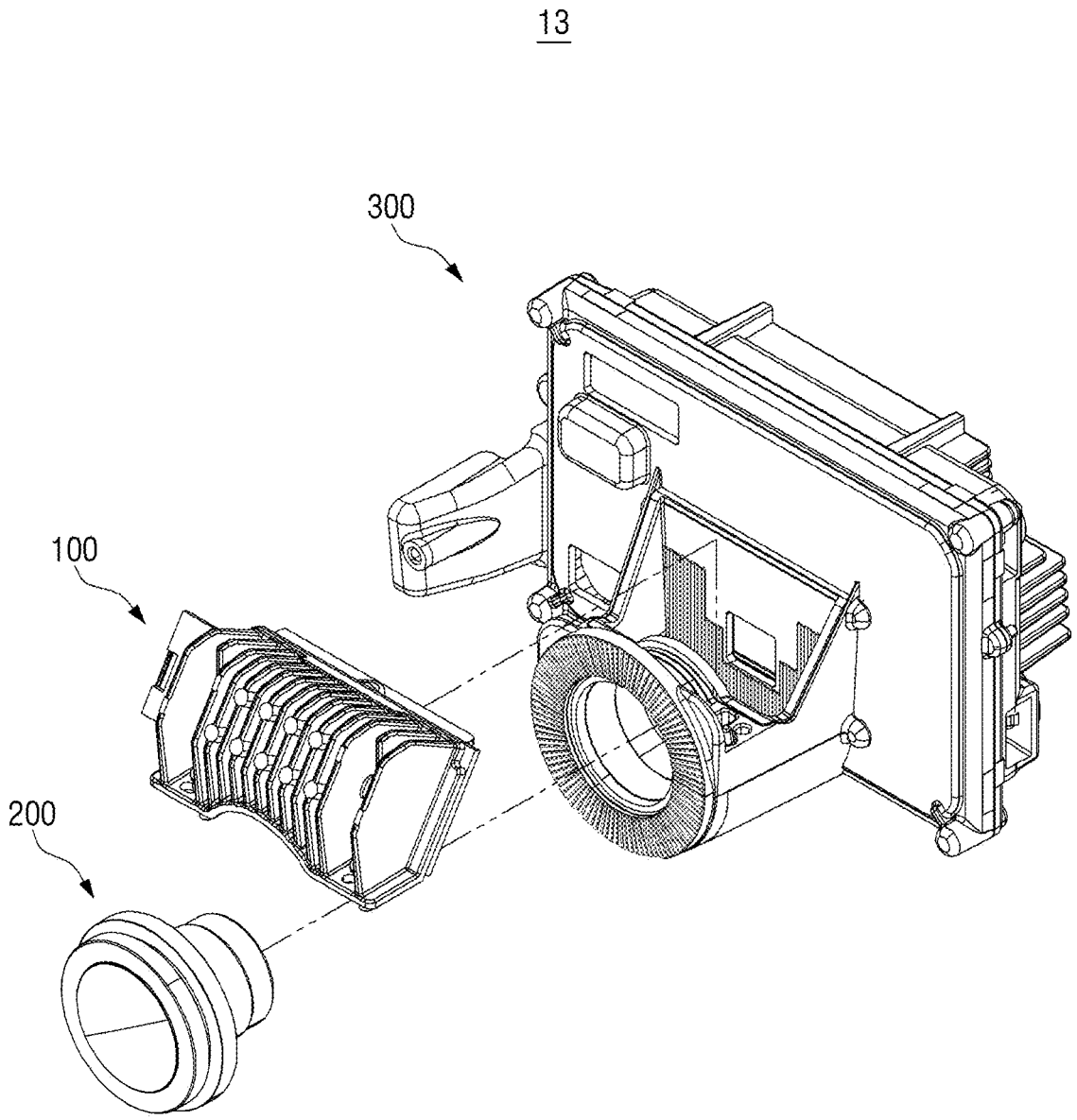
FIG. 10 is an exploded perspective view of the variable beam forming part.

FIG. 9 is a perspective view of the variable beam forming part, and FIG. 10 is an exploded perspective view of the variable beam forming part. Referring to FIGS. 9 and 10, the variable beam forming part 13 may include a first optical part 100, a second optical part 200, and a beam pattern forming part 300.

The first optical part 100 may irradiate light. The first optical part 100 may include a first optical group 181 (see FIG. 15) and a second optical group 182 (see FIG. 15). The first optical group 181 may irradiate light for forming the first variable beam pattern VP1, and the second optical group 182 may irradiate light for forming the second variable beam pattern VP2. The light of the first optical group 181 and the light of the second optical group 182 may be reflected and subsequently irradiated to the front of the vehicle 1.

The beam pattern forming part 300 may reflect the light of the first optical part 100 to form the variable beam patterns VP1 and VP2. The light irradiated by the first optical part 100 may be reflected by the beam pattern forming part 300 to form the variable beam patterns VP1 and VP2. The beam pattern forming part 300 may form a beam pattern of a particular shape by reflecting some of the incident lights towards the second optical part 200 and reflecting other incident light so that it does not reach the second optical part 200. A detailed description of the beam pattern forming part 300 will be described below with reference to FIGS. 11 to 14.

The second optical part 200 may transmit the light from the beam pattern forming part 300. The second optical part 200 may condense and irradiate the incident light. Accordingly, the first variable beam pattern VP1 and the second variable beam pattern VP2 of the aforementioned shape may be formed. For the condensation of light, the second optical part 200 may include a plurality of lenses. The light incident on the second optical part 200 may be condensed and emitted by being transmitted through the plurality of lenses.

Figure 11:
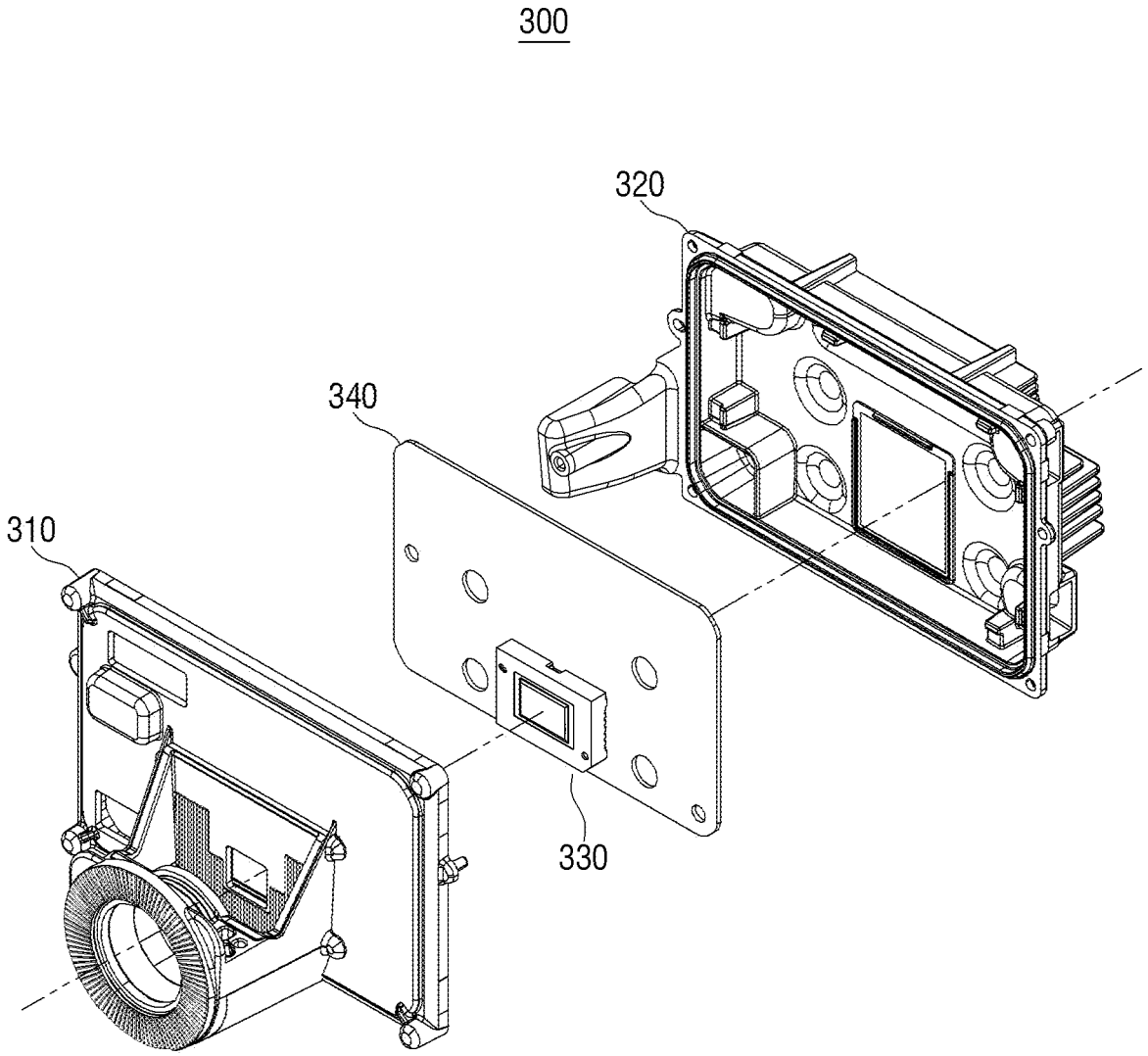
FIG. 11 is an exploded perspective view of a beam pattern forming part of the variable beam forming part.
Figure 12:
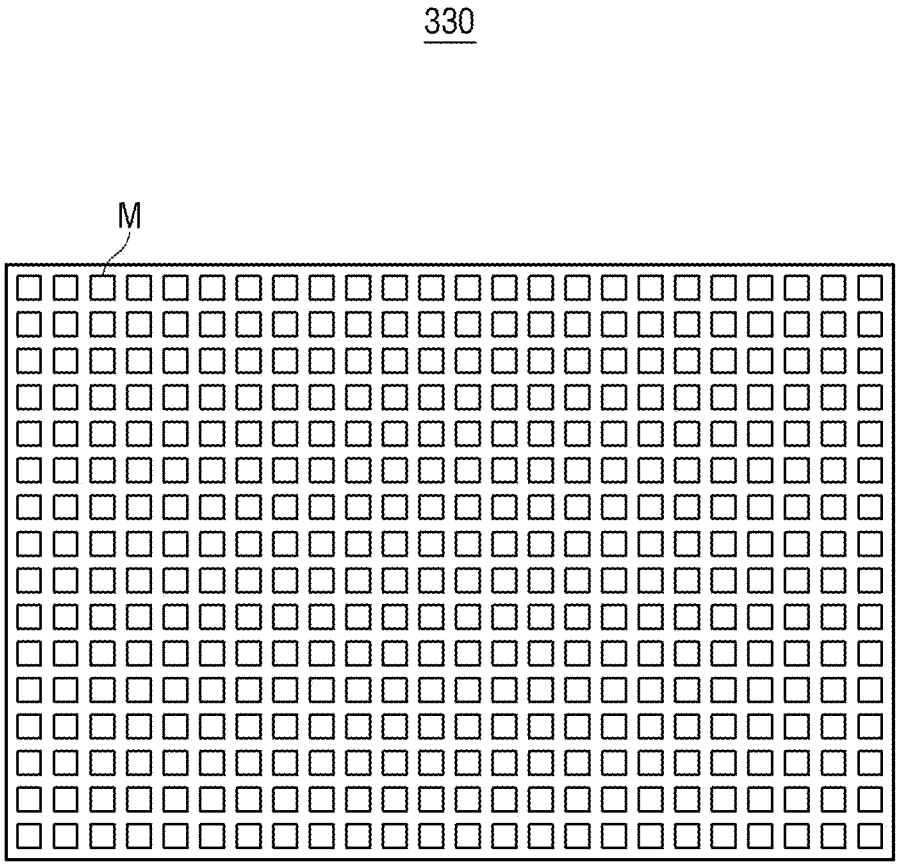
FIG. 12 is a top plan view of a reflection part of the beam pattern forming part.
Figure 13:
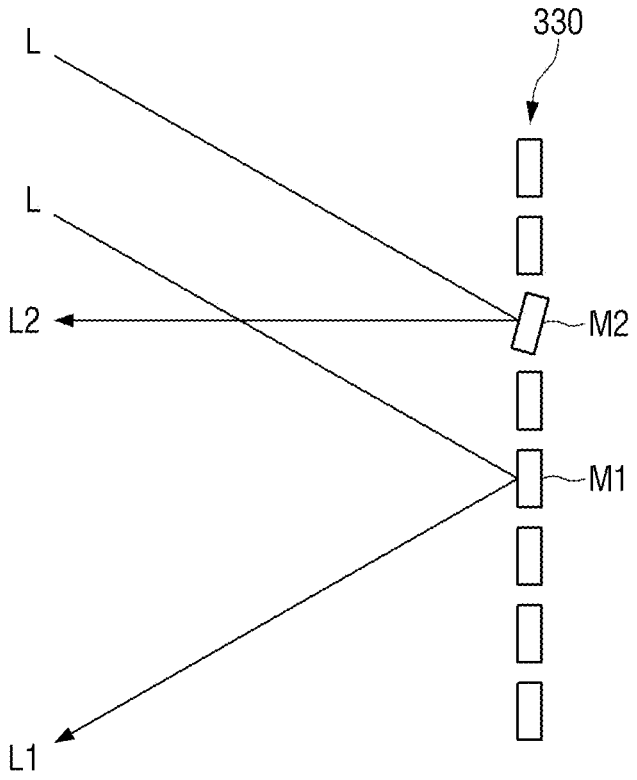
FIG. 13 depicts an operating principle of the reflection part of the lamp for vehicle according to an embodiment of the present disclosure.
Figure 14:
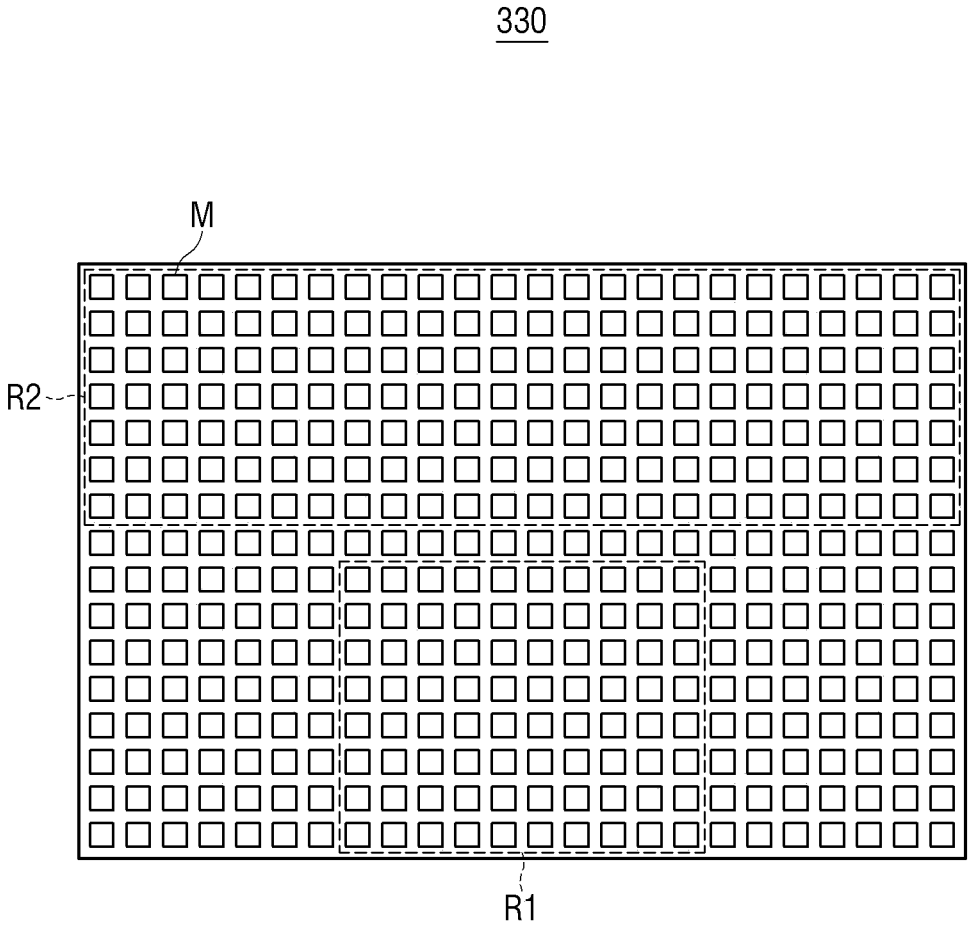
FIG. 14 depicts a reflection region of the reflection part of the lamp for vehicle according to an embodiment of the present disclosure.

FIG. 11 is an exploded perspective view of the beam pattern forming part, FIG. 12 is a top plan view of a reflection part, FIG. 13 is a view describing an operating principle of the reflection part, and FIG. 14 is a view describing a reflection region of the reflection part.

Referring to FIG. 11, the beam pattern forming part 300 may include housings 310 and 320, a reflection part 330, and a substrate 340.

The housings 310 and 320 may include a first housing 310 and a second housing 320. The first housing 310 and the second housing 320 may be coupled to each other to provide an accommodation space for the reflection part 330 and the substrate 340. The first housing 310 may be coupled to the first optical part 100 and the second optical part 200. The reflection part 330, the substrate 340, the first optical part 100, and the second optical part 200 may be accommodated in the housings 310 and 320 and/or coupled thereto, thus allowing the lamp 10 for a vehicle to operate integrally.

Referring to FIG. 12, the reflection part 330 may include a plurality of micromirrors M. The micromirrors M may reflect the light incident from the first optical part 100. In particular, the posture of the plurality of micromirrors M may be individually adjusted. Furthermore, an irradiation angle of reflected light may be varied depending on the posture of each micromirror M. In other words, the light incident on the reflection part 330 may be reflected by the plurality of micromirrors M, and the irradiation angle of partial light reflected by a micromirror M may be varied depending on the posture of the micromirror M.

Referring to FIG. 13, the postures of the micromirrors M1 and M2 may be adjusted. Specifically, the postures of each of the micromirrors M1 and M2 constituting the reflection part 330 may be individually determined.

In the present disclosure, the micromirrors M1 and M2 may include two positions. FIG. 13 illustrates the micromirror M1 disposed at a first posture and the micromirror M2 disposed at a second posture. By being disposed at the first posture, the micromirror M1 may reflect an incident light L and irradiate the same in a first direction L1. Meanwhile, by being disposed at the second posture, the micromirror M2 may reflect the incident light L and irradiate the same in a second direction L2 that is different from the first direction L1.

The plurality of micromirrors M1 and M2 included in the reflection part 330 may each have the posture for collectively forming a specific image. For instance, the plurality of micromirrors M1 and M2 may have the postures for forming an image of an arrow. When the micromirrors M2 corresponding to the image of the arrow have the second posture and the remaining micromirrors M1 have the first posture, the variable beam patterns VP1 and VP2 may be formed to include a driving information image of the arrow.

The micromirror M according to an embodiment of the present disclosure may be implemented with known technologies such as disclosed in, for example, Korean Patent Application Publication No. 10-2019-0063984 published on Jun. 10, 2019, relevant portions of which are incorporated herein by reference.

Referring to FIG. 14, the reflection part 330 may include a first reflection region R1 and a second reflection region R2. The first reflection region R1 may be configured to form the first variable beam pattern VP1, and the second reflection region R2 may be configured to form the second variable beam pattern VP2. The first variable beam pattern VP1 may be formed by reflecting light with at least some of the selected micromirrors M included in the first reflection region R1, and the second variable beam pattern VP2 may be formed by reflecting light with at least some of the selected micromirrors M included in the second reflection region R2.

The first reflection region R1 may have a similar shape to the first variable beam pattern VP1, and the second reflection region R2 may have a similar shape to the second variable beam pattern VP2. Specifically, the area of the second reflection region R2 may be formed to be greater than the area of the first reflection region R1, and the horizontal length of the second reflection region R2 may be formed to be greater than the horizontal length of the first reflection region R1.

The second reflection region R2 may be disposed above the first reflection region R1. In the present disclosure, the light reflected in the first reflection region R1 and the light reflected in the second reflection region R2 may intersect each other and be irradiated to the second optical part 200. Specifically, the light reflected on the first reflection region R1 may be irradiated upwards as compared to the light reflected on the second reflection region R2, and the light reflected in the second reflection region R2 may be irradiated downwards as compared to the light reflected in the first reflection region R1. Accordingly, the light reflected on the first reflection region R1 may be incident on an upper side of the second optical part 200 as compared to the light reflected on the second reflection region R2, and the light reflected on the second reflection region R2 may be incident on a lower side of the second optical part 200 as compared to the light reflected on the first reflection region R1.

The light reflected on the first reflection region R1 may be irradiated farther than the light reflected on the second reflection region R2 to form the first variable beam pattern VP1, and the light reflected on the second reflection region R2 may be irradiated closer than the light reflected on the first reflection region R1 to form the second variable beam pattern VP2.

Referring back to FIG. 11, the substrate 340 may support the reflection part 330. For example, the reflection part 330 may be coupled to a slot provided in the substrate 340. In turn, the substrate 340 may be coupled to the housings 310 and 320. Accordingly, the position of the reflection part 330 may be fixed together with the substrate 340 inside the housings 310 and 320. The substrate 340 may receive electric power from outside and may transmit the power to the reflection part 330. The reflection part 330 may operate with the power transmitted from the substrate 340 and may reflect the incident light in a specific pattern.

Figure 15:
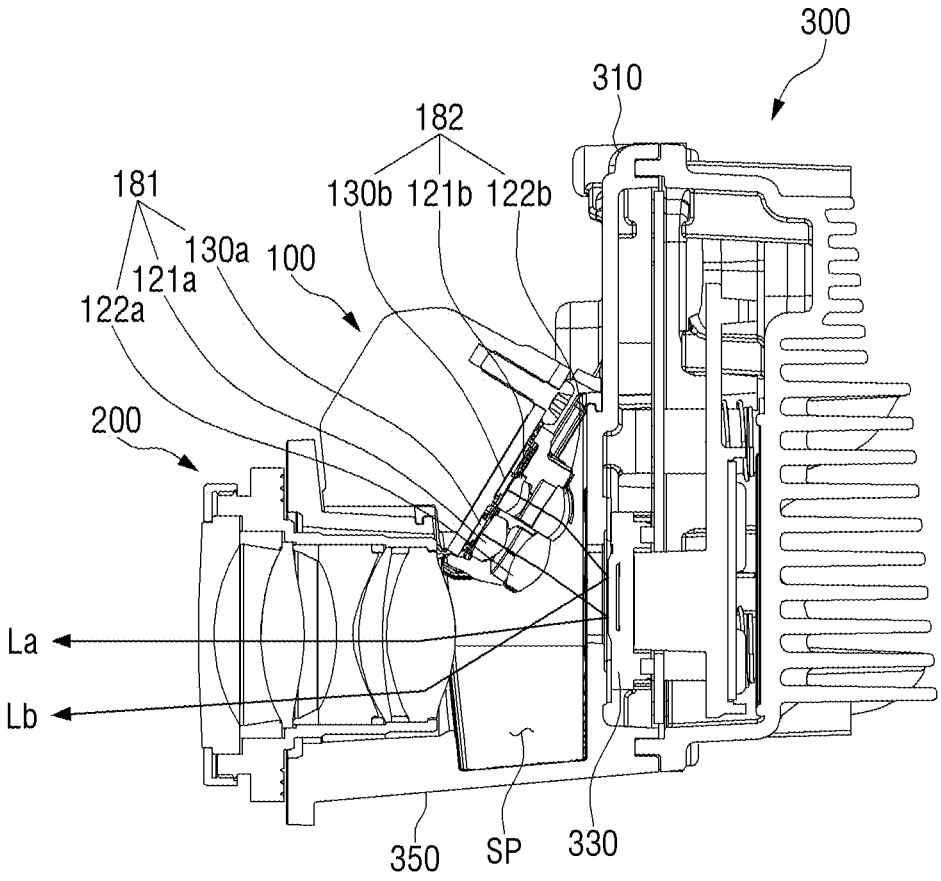
FIG. 15 depicts light irradiated by the variable beam forming part of the lamp for vehicle according to an embodiment of the present disclosure.

FIG. 15 depicts the light irradiated by the variable beam forming part. Referring to FIG. 15, the light irradiated by the first optical part 100 may be reflected by the reflection part 330 and then transmitted through the second optical part 200. The first optical part 100 may include a first optical group 181 and a second optical group 182. The first optical group 181 may irradiate light La for forming the first variable beam pattern VP1. The first optical group 181 may include a first light source 130*a* and first lens sets 121*a* and 122*a*. The first light source 130*a* may generate the first light. The first lens sets 121*a* and 122*a* may include a plurality of lenses spaced apart from one another and transmit the first light therethrough.

The second optical group 182 may emit light Lb for forming the second variable beam pattern VP2. The second optical group 182 may include a second light source 130*b* and second lens sets 121*b* and 122*b*. The second light source 130*b* may generate the second light. The second lens sets 121*b* and 122*b* may include a plurality of lenses spaced apart from one another and transmit the second light therethrough.

The light irradiated from the first optical group 181 may be reflected by the reflection part 330 and then transmitted through the second optical part 200, thus forming the first variable beam pattern VP1. The light irradiated from the second optical group 182 may be reflected by the reflection part 330 and then transmitted through the second optical part 200, thus forming the second variable beam pattern VP2.

The first housing 310 may include an auxiliary housing 350. The auxiliary housing 350 may include a space (e.g., a cavity) SP for passage of the light that is irradiated by the first optical part 100 and the light that is reflected by the reflection part 330. Some of the lights irradiated by the first optical part 100 or the light reflected by the reflection part 330 may be irradiated to an inner surface of the auxiliary housing 350. For instance, among the micromirrors M included in the reflection part 330, the micromirrors M having the first posture may reflect the light to a bottom surface of the auxiliary housing 350.

The light irradiated to the inner surface of the auxiliary housing 350 may be secondarily reflected from the corresponding inner surface. When the light reflected from the inner surface of the auxiliary housing 350 enters the second optical part 200, glare may occur.

In the present disclosure, therefore, the housings 310 and 320 may include an anti-reflection member for preventing the secondary reflection of the light that has been reflected by the reflection part 330. The anti-reflection member may be formed on the inner surface of the auxiliary housing 350 to absorb or diffuse incident light. Thus, the occurrence of the glare may be reduced or prevented by absorbing or diffusing the light by the anti-reflection member. Hereinafter, the anti-reflection member that diffuses light will be described with reference to FIGS. 14 to 21.

Figure 16:
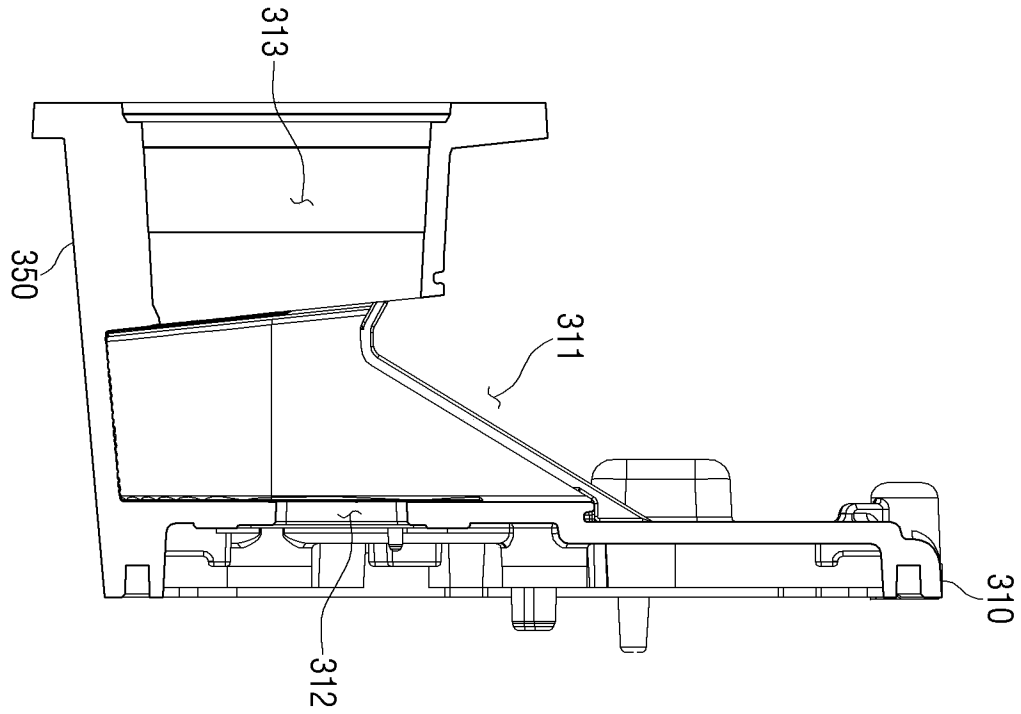
FIG. 16 is a cross-sectional view of a first housing of the lamp for vehicle according to an embodiment of the present disclosure.

FIG. 16 is a cross-sectional view of the first housing. Referring to FIG. 16, the first housing 310 may include a first light transmitting aperture 311, a second light transmitting aperture 312, and a third light transmitting aperture 313. The first light transmitting aperture 311 may transmit the light irradiated from the first optical part 100. The first optical part 100 may be disposed adjacent to the first light transmitting aperture 311 to irradiate the light. The light irradiated from the first optical part 100 may pass through the first light transmitting aperture 311 and be transmitted to the reflection part 330.

The second light transmitting aperture 312 may transmit the light irradiated from the first optical part 100 and the light reflected by the reflection part 330. The light irradiated from the first optical part 100 may pass through the second light transmitting aperture 312 and be transmitted to the reflection part 330. Subsequently, the light reflected by the reflection part 330 may pass through the second light transmitting aperture 312 again and be transmitted to the second optical part 200.

The third light transmitting aperture 313 may transmit the light to be incident on the second optical part 200. The second optical part 200 may be disposed in the third light transmitting aperture 313 to transmit the light reflected by the reflection part 330.

The first housing 310 may include the auxiliary housing 350. The auxiliary housing 350 that supports the second optical part 200 may prevent light that is not incident on the second optical part 200 from being emitted to the exterior, among the light reflected by the reflection part 330.

Figure 17:
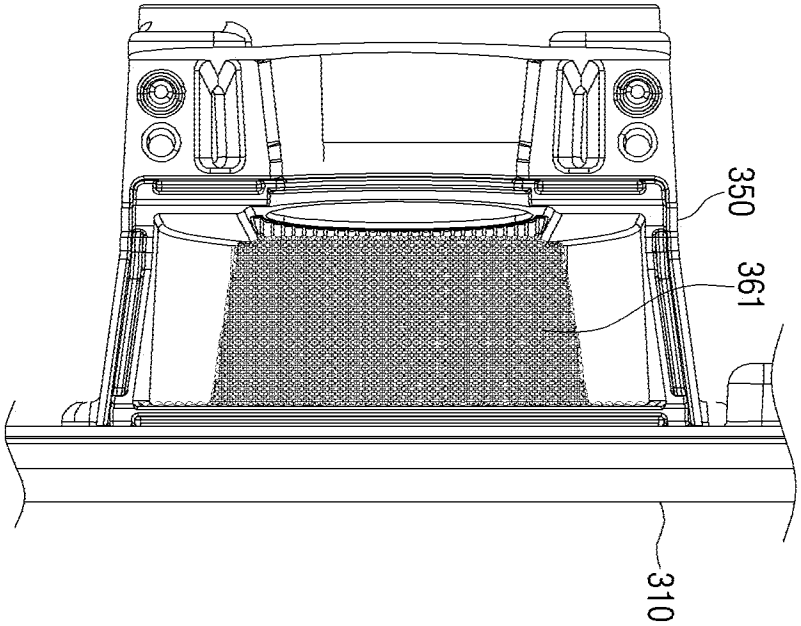
FIG. 17 illustrates an inner bottom surface of an auxiliary housing of the lamp for vehicle according to an embodiment of the present disclosure.
Figure 18:
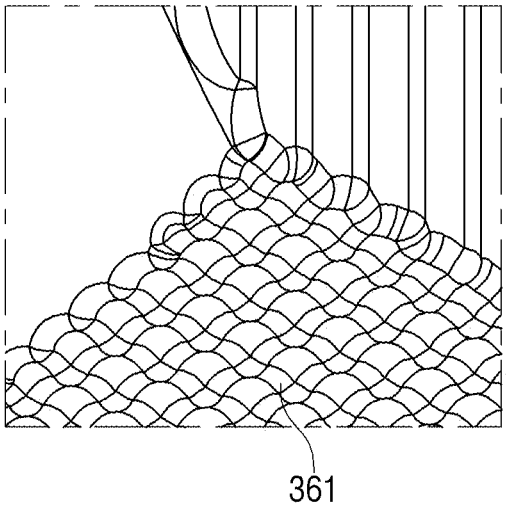
FIG. 18 is an enlarged view of a first light diffusion part of the lamp for vehicle according to an embodiment of the present disclosure.

FIG. 17 shows an inner bottom surface of the auxiliary housing, and FIG. 18 is an enlarged view of a first light diffusion part. Referring to FIG. 17, the anti-reflection member may be formed on the inner bottom surface of the auxiliary housing 350. The anti-reflection member may include a first light diffusion part 361 formed on the inner bottom surface of the auxiliary housing 350 and configured to diffuse incident light.

Referring to FIG. 18, the first light diffusion part 361 may include a hemispherical convex surface and a hemispherical concave surface. The hemispherical convex surface and the hemispherical concave surface may be provided in plurality and arranged in a lattice shape to diffuse the incident light. For instance, the light incident on the first light diffusion part 361 may be diffused in four or more directions. Even if some of the light incident on the first light diffusion part 361 may be transmitted to the second optical part 200, the occurrence of the glare may be reduced, as the light is diffused and attenuated before being transmitted to the second optical part 200.

Figure 19:
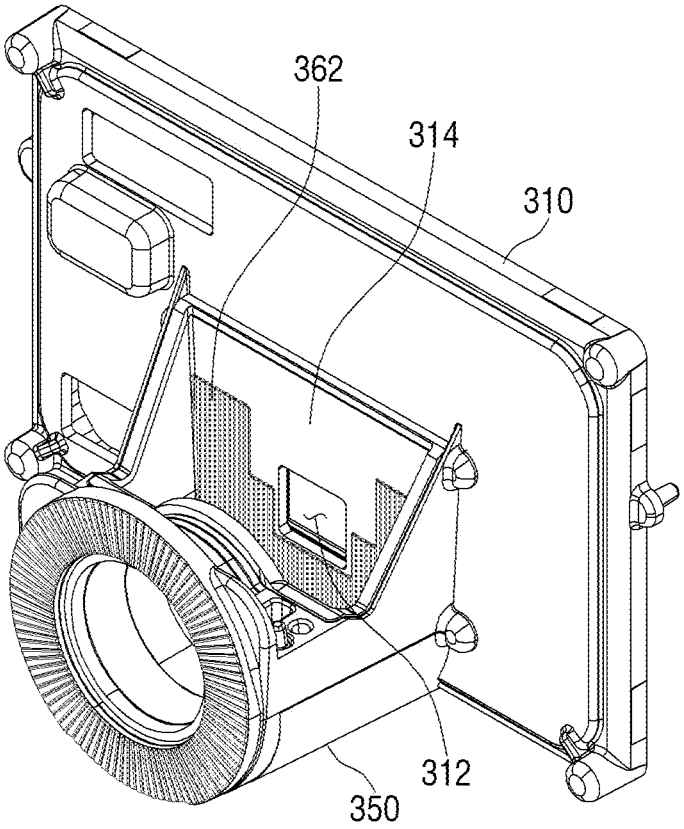
FIG. 19 is a perspective view of the first housing of the lamp for vehicle according to an embodiment of the present disclosure.
Figure 20:
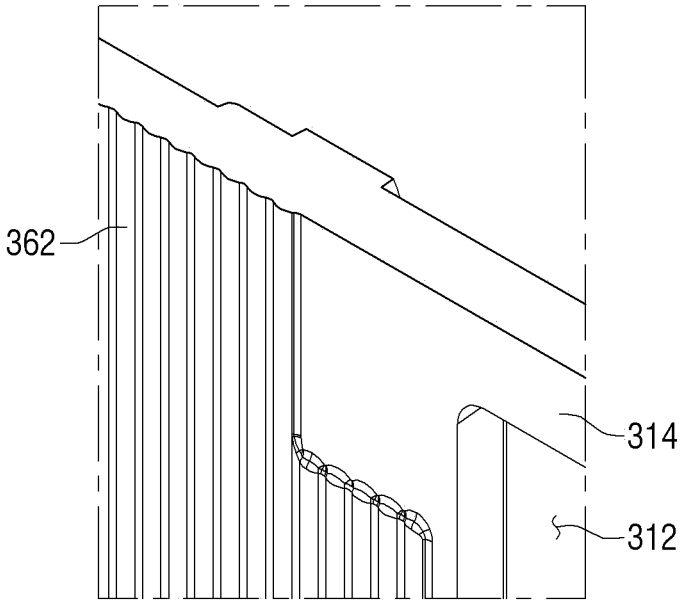
FIG. 20 is an enlarged view of a second light diffusion part of the lamp for vehicle according to an embodiment of the present disclosure.

FIG. 19 is a perspective view of the first housing, and FIG. 20 is an enlarged view of a second light diffusion part. Referring to FIG. 19, the first housing 310 may include a light transmitting plate 314. The light transmitting plate 314 may be sealed by the auxiliary housing 350 and may be disposed between the reflection part 330 and the second optical part 200. The light transmitting plate 314 may include the second light transmitting aperture 312 configured to transmit the light reflected by the reflection part 330. The anti-reflection member may include a second light diffusion part 362 formed on a surface of the light transmitting plate 314 that faces the second optical part 200 and configured to diffuse the incident light. The light reflected from the inner surface of the auxiliary housing 350 may be transmitted to the light transmitting plate 314. The second light diffusion part 362 may diffuse the incident light reflected from the inner surface of the auxiliary housing 350.

Referring to FIG. 20, the second light diffusion part 362 may include semicircular pillar-shaped convex and concave surfaces elongated in the vertical direction. Due to the second light diffusion part 362 including the semicircular pillar-shaped convex and concave surfaces elongated in the vertical direction, the light incident on the second light diffusion part 362 may be generally diffused in the horizontal direction. If light is diffused in the vertical direction from the second light diffusion part 362, the diffused light may enter the first optical part 100 and increase the temperature of the first optical part 100. As the second light diffusion part 362 diffuses the light substantially in the horizontal direction, the diffused light may be prevented from entering the first optical part 100.

Referring back to FIG. 19, the second light diffusion part 362 may not be formed in at least part of an edge of the second light transmitting aperture 312 on a surface of the light transmitting plate 314. Specifically, no second light diffusion part 362 may be formed along an upper edge of the second light transmitting aperture 312.

The light diffused from the second light diffusion part 362 may enter the reflection part 330 through the second light transmitting aperture 312. When the light entering the reflection part 330 is reflected again, the glare may be formed or an unintended beam pattern may be formed. Specifically, the first reflection region R1 of the reflection part 330 may be formed in an upper part of the reflection part 330. The first reflection region R1 may be formed over a left edge and a right edge of the reflection part 330. When the light diffused from the second light diffusion part 362 enters the reflection part 330, the shape of the second variable beam pattern VP2 may be distorted. However, since the second light diffusion part 362 is not formed along the edge of the second light transmitting aperture 312, the distortion of the second variable beam pattern VP2 may be prevented.

Figure 21:
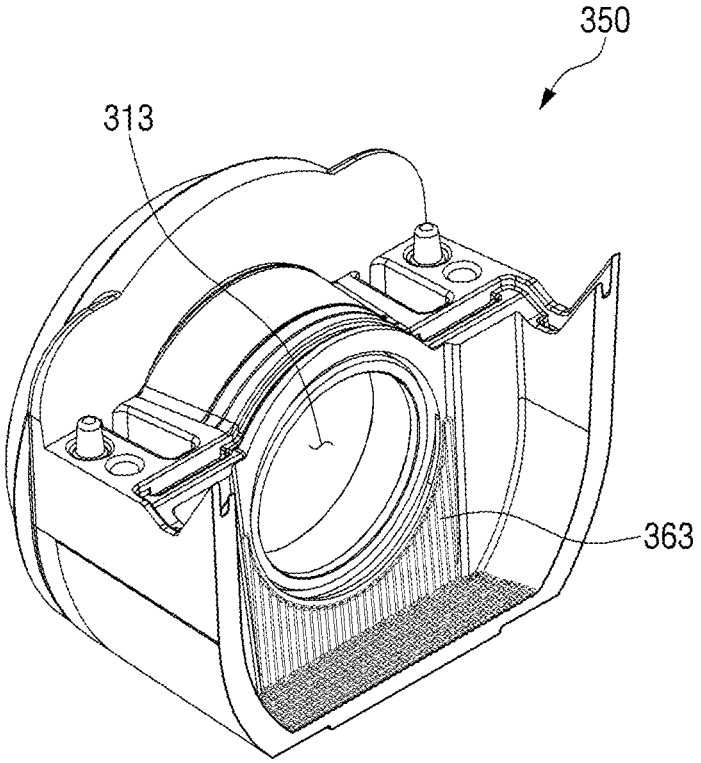
FIG. 21 illustrates the inside of the auxiliary housing of the lamp for vehicle according to an embodiment of the present disclosure.

FIG. 21 shows the inside of the auxiliary housing. Referring to FIG. 21, the auxiliary housing 350 may include the third light transmitting aperture 313 equipped with the second optical part 200 and configured to transmit the light to be incident on the second optical part 200

The anti-reflection member may include a third light diffusion part 363 formed on the inner surface of the auxiliary housing 350 adjacent to the third light transmitting aperture 313 and configured to diffuse the incident light. The light reflected from the inner surface of the auxiliary housing 350 may be transmitted to the inner surface of the auxiliary housing 350 adjacent to the third light transmitting aperture 313. The third light diffusion part 363 may diffuse the incident light reflected from the inner surface of the auxiliary housing 350. Similarly to the second light diffusion part 362, the third light diffusion part 363 may include semicircular pillar-shaped convex and concave surfaces elongated in the vertical direction. With the formation of the third light diffusion part 363 including the semicircular pillar-shaped convex and concave surfaces elongated in the vertical direction, the light incident on the third light diffusion part 363 may be generally diffused in the horizontal direction.

Figure 22:
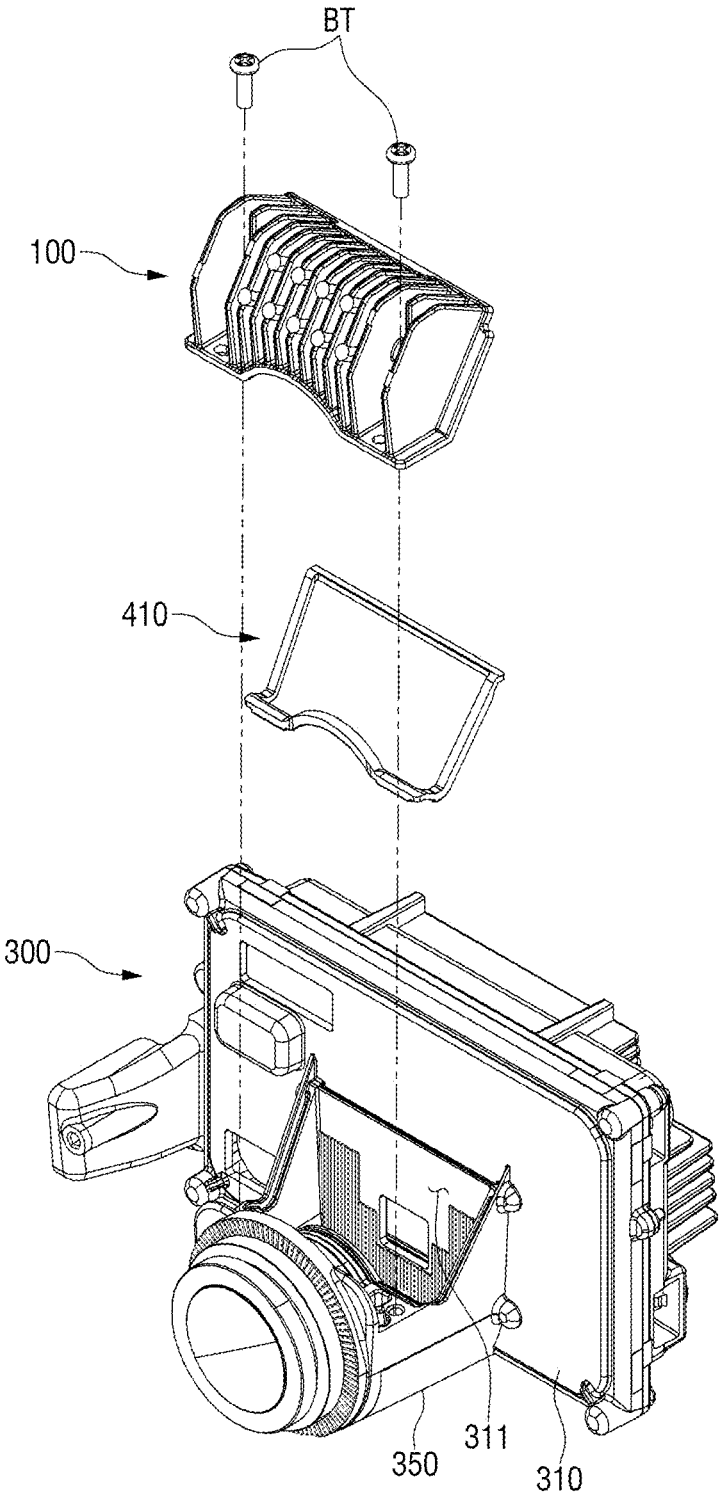
FIG. 22 illustrates the first optical part coupled to the beam pattern forming part according to an embodiment of the present disclosure.

FIG. 22 illustrates the first optical part being coupled to the beam pattern forming part. Referring to FIG. 22, the first optical part 100 may be coupled to the beam pattern forming part 300. The first optical part 100 may be coupled to the first housing 310 of the beam pattern forming part 300. Specifically, the first optical part 100 may be coupled to the auxiliary housing 350 by, for example, using a screw-coupling.

The auxiliary housing 350 may include the first light transmitting aperture 311 configured to receive the light from the first optical part 100. If the first optical part 100 and the auxiliary housing 350 do not come in sufficiently close contact with each other, a gap may occur between the first optical part 100 and the auxiliary housing 350. If a gap is formed between the first optical part 100 and the auxiliary housing 350, foreign substances may enter the auxiliary housing 350 through the gap.

Accordingly, a first sealing part 410 may be provided to prevent foreign substances. The first sealing part 410 may be disposed between the first optical part 100 and the beam pattern forming part 300 to seal the inside of the beam pattern forming part 300. For instance, the first sealing part 410 may include a material of a relatively high resilience, such as rubber, urethane, or silicone. As the first sealing part 410 seals any gap between the first optical part 100 and the auxiliary housing 350, foreign materials may be prevented from entering the beam pattern forming part 300.

Figure 23:
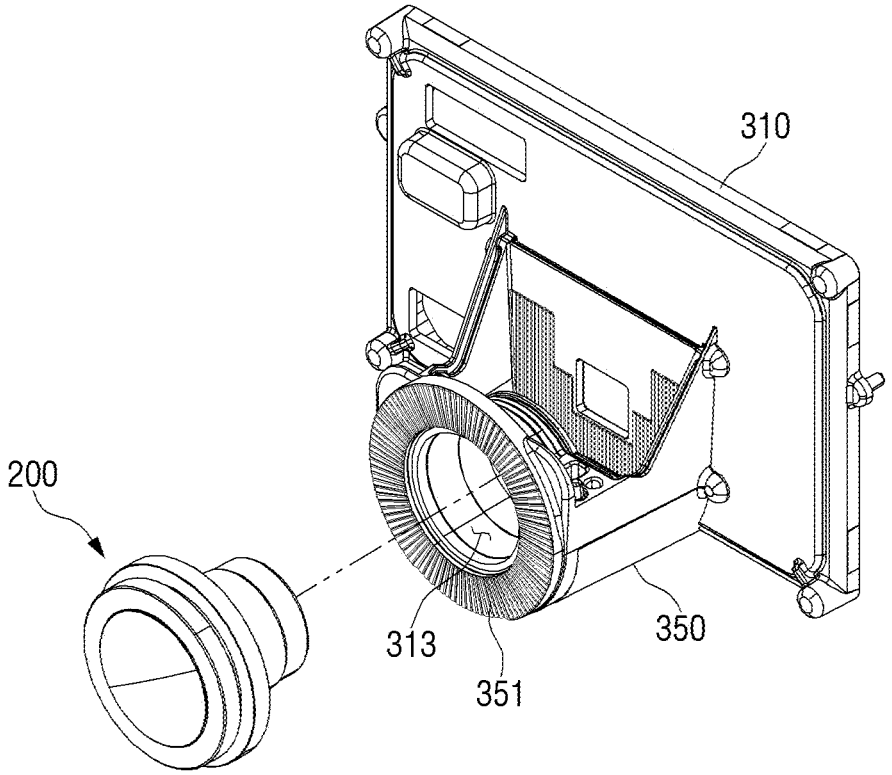
FIG. 23 illustrates the second optical part coupled to the auxiliary housing according to an embodiment of the present disclosure.
Figure 24:
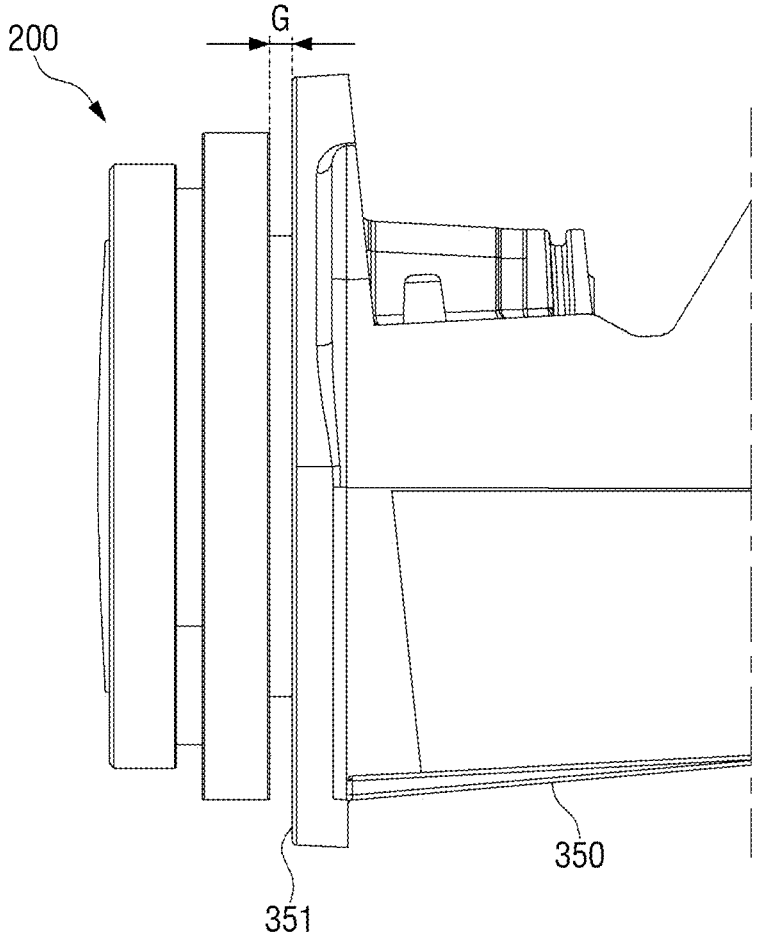
FIG. 24 depicts the arrangement relationship of the second optical part with respect to the auxiliary housing according to an embodiment of the present disclosure.
Figure 25:
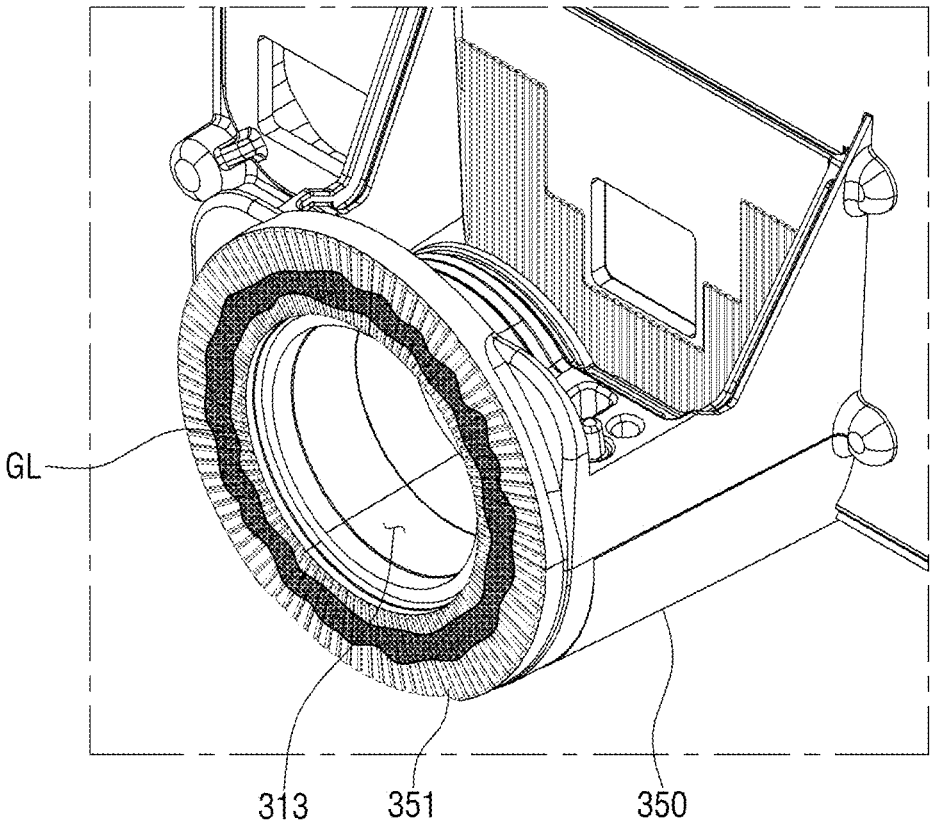
FIG. 25 illustrates an adhesive applied to the auxiliary housing according to an embodiment of the present disclosure.
Figure 26:
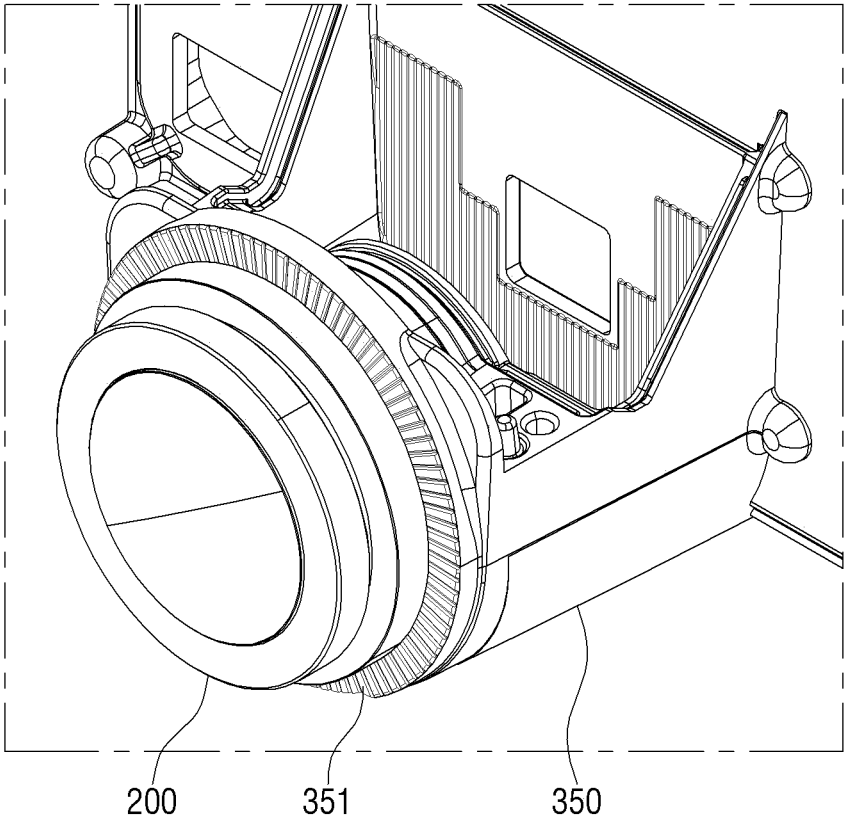
FIG. 26 illustrates the second optical part coupled to the auxiliary housing using the adhesive according to an embodiment of the present disclosure.
Figure 27:
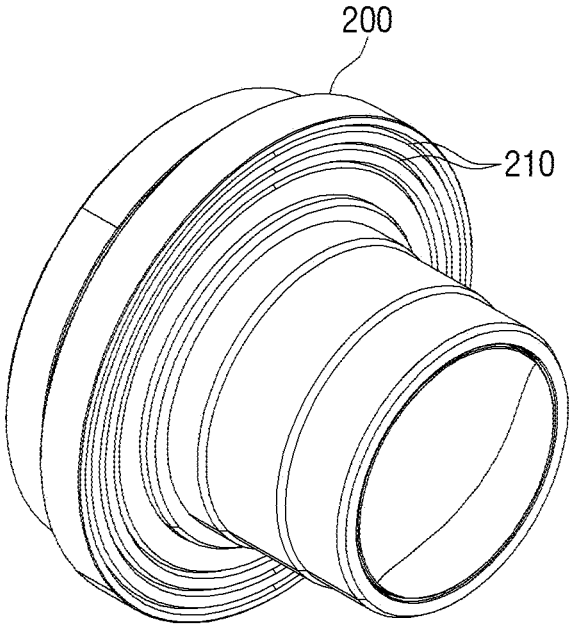
FIG. 27 is a rear perspective view of the second optical part of the lamp for vehicle according to an embodiment of the present disclosure.

FIG. 23 illustrates the second optical part being coupled to the auxiliary housing, FIG. 24 depicts the arrangement relationship of the second optical part with respect to the auxiliary housing, FIG. 25 illustrates an adhesive applied to the auxiliary housing, FIG. 26 illustrates the second optical part coupled to the auxiliary housing using the adhesive, and FIG. 27 is a rear perspective view of the second optical part.

Referring to FIG. 23, the second optical part 200 may be coupled to the auxiliary housing 350. The auxiliary housing 350 may include the third light transmitting aperture 313 and may support the second optical part 200 inserted into the third light transmitting aperture 313. The second optical part 200 may be inserted into the third light transmitting aperture 313 formed in the auxiliary housing 350 and thereby coupled to the auxiliary housing 350.

If the second optical part 200 is spaced apart from an outer surface 351 of the auxiliary housing 350 by some distance, a gap may occur between the second optical part 200 and the auxiliary housing 350. If a gap is formed between the second optical part 200 and the auxiliary housing 350, foreign substances may enter the auxiliary housing 350 through the gap. In order to prevent the foreign substances, the second optical part 200 and the auxiliary housing 350 may be coupled using an adhesive. More specifically, the second optical part 200 may be coupled to the auxiliary housing 350 by using the adhesive applied to the outer surface 351 of the auxiliary housing 350.

Hereinafter, the process of coupling the second optical part 200 to the auxiliary housing 350 will be described with reference to FIGS. 24 to 27. Referring to FIG. 24, the second optical part 200 may be disposed to be spaced apart from the frontal surface of the auxiliary housing 350 by a predetermined distance. In manufacturing the variable beam forming part 13, a distance between the reflection part 330 and the outer surface 351 of the auxiliary housing 350 may not be consistent due to design and assembly tolerances. Thus, if the second optical part 200 is inserted all the way until it abuts the outer surface 351 of the auxiliary housing 350, the variable beam patterns VP1 and VP2 may not be correctly formed.

Accordingly, the second optical part 200 may be inserted into the third light transmitting aperture 313 to a predetermined depth and coupled to the auxiliary housing 350. The second optical part 200 may be coupled to the auxiliary housing 350 to maintain a predetermined distance between the ends of the reflection part 330 and the second optical part 200 such that a space may be generated by a predetermined distance G between the second optical part 200 and the outer surface 351 of the auxiliary housing 350.

The position of the second optical part 200 with respect to the auxiliary housing 350 may be determined before the second optical part 200 is coupled to the auxiliary housing 350. For instance, a distance between the second optical part 200 and the outer surface 351 of the auxiliary housing 350 may be measured. Hereinafter, a position where the second optical part 200 is desired to be maintained with respect to the reflection part 330 is referred to as a target position.

After determining the position of the second optical part 200 with respect to the auxiliary housing 350, an adhesive GL may be applied to the outer surface 351 of the auxiliary housing 350, as illustrated in FIG. 25. The adhesive GL may be applied in the form of a ring, which is a shape of the outer surface 351 of the auxiliary housing 350. In some embodiments, corrugation may be formed on the outer surface 351 of the auxiliary housing 350. The corrugation may increase a surface area to which the adhesive GL is applied; therefore, the coupling between the second optical part 200 and the auxiliary housing 350 may be achieved with a stronger adhesive force.

After the adhesive GL is applied to the outer surface 351 of the auxiliary housing 350, the second optical part 200 may be inserted into the third light transmitting aperture 313 and coupled to the auxiliary housing 350, as illustrated in FIG. 26. In particular, an insertion depth of the third light transmitting aperture 313 may be determined so that the second optical part 200 is disposed at the predetermined target position. As the second optical part 200 is inserted into the third light transmitting aperture 313 at an appropriate depth, the second optical part 200 may be disposed in the target position.

In some embodiments, the adhesive GL used to couple the second optical part 200 to the auxiliary housing 350 may be an ultraviolet adhesive, which hardens in response to being exposed to ultraviolet rays. Accordingly, the adhesive GL may be applied to the outer surface 351 of the auxiliary housing 350, and ultraviolet rays may be irradiated to the adhesive GL after the second optical part 200 is placed at the target position, thus coupling the second optical part 200 to the auxiliary housing 350. However, the present disclosure is not limited thereto, and any types of adhesives may be used to adhere the second optical part 200 and the auxiliary housing 350.

Referring to FIG. 27, the second optical part 200 may include an adhesive groove 210. The adhesive groove 210 may be formed on a surface of the second optical part 200 that faces the outer surface 351 of the auxiliary housing 350. The adhesive groove 210 may be provided in the form of a ring or of a straight line. The adhesive groove 210 may be provided in a shape and a size sufficient to accommodate the adhesive GL.

With the formation of the adhesive groove 210 in the second optical part 200, the area where the adhesive GL is applied may be increased such that the coupling between the second optical part 200 and the auxiliary housing 350 may be achieved with a stronger adhesive force.

As the second optical part 200 may be coupled to the auxiliary housing 350 via the above-described process, the second optical part 200 may be disposed at the target position. In addition, the adhesive GL applied between the second optical part 200 and the auxiliary housing 350 may seal the gap between the second optical part 200 and the auxiliary housing 350, thereby preventing the foreign substances from entering through the third light transmitting aperture 313.

Figure 28:
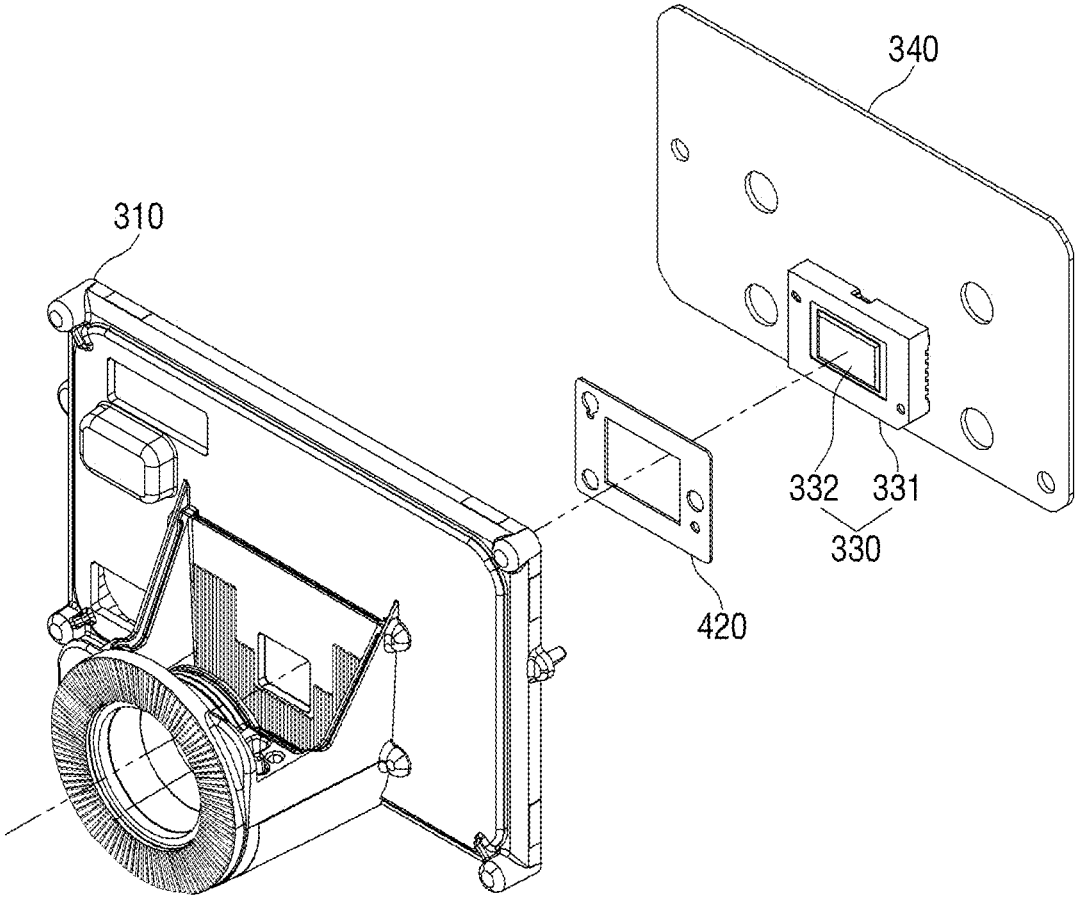
FIG. 28 depicts the reflection part sealed by the second sealing part according to an embodiment of the present disclosure.
Figure 29:
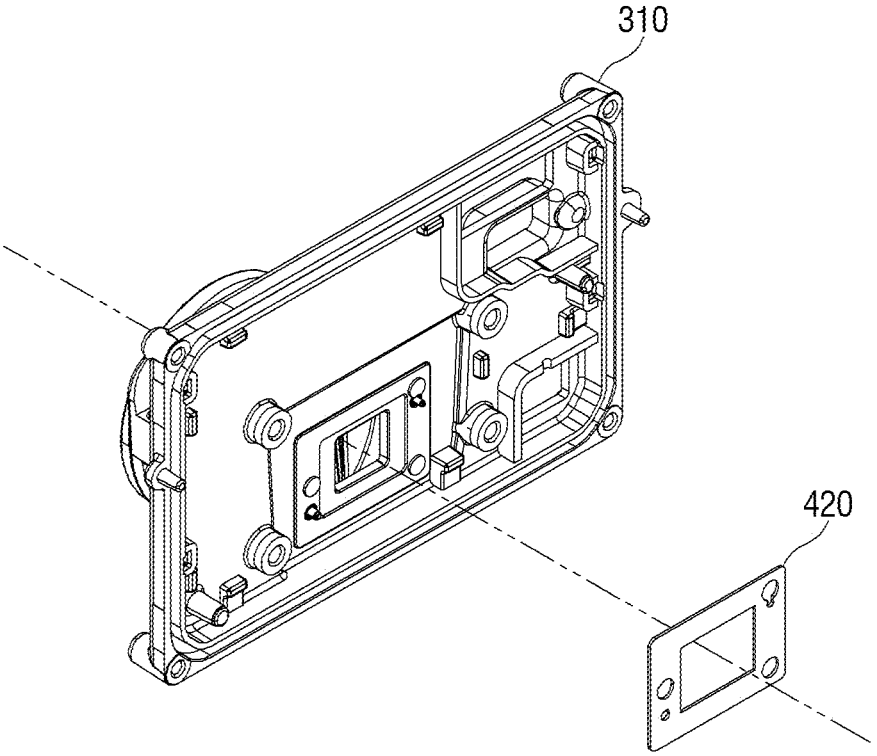
FIG. 29 depicts an arrangement relationship between the second sealing part and the first housing according to an embodiment of the present disclosure.

FIG. 28 depicts the reflection part sealed by a second sealing part, and FIG. 29 depicts an arrangement relationship between the second sealing part 420 and the first housing 310. Referring to FIGS. 28 and 29, the reflection part 330 may be sealed by the second sealing part 420.

The second sealing part 420 may be arranged along a surface edge of the reflection part 330, and may seal a surface of the reflection part 330 by closely contacting inner surfaces of the first housing 310. The reflection part 330 may include a control module 331 and a mirror module 332. The control module 331 may be coupled to the substrate 340 to receive a control signal and power, and may control the mirror module 332 using the control signal and the power. The mirror module 332 may include the micromirrors M described above. The control module 331 may be configured to adjust the postures of the micromirrors M included in the mirror module 332 to reflect the incident light.

When the foreign substances are attached to a surface of the mirror module 332, the variable beam patterns VP1 and VP2 may be distorted. Furthermore, when excessive amount of foreign substances are attached to the surface of the mirror module 332, the mirror module 332 may be damaged. The mirror module 332 may be surrounded by the control module 331 and only the surface thereof may be exposed to the outside. The second sealing part 420 may be disposed on a surface of the control module 331 that is an edge of the mirror module 332. To this end, the second sealing part 420 may be provided in the shape of a ring or a closed loop.

In addition, as illustrated in FIG. 29, the second sealing part 420 may abut an inner surface of the first housing 310. As the second sealing part 420 surrounds the edge of the mirror module 332 and abuts the inner surface of the first housing 310, foreign substances may be prevented from reaching the mirror module 332 through other paths except the second light transmitting aperture 312.

Further, the second sealing part 420 may thermally insulate the reflecting part 330 from the housings 310 and 320. Specifically, the second sealing part 420 may obstruct heat from being transmitted from the first housing 310 to the mirror module 332 of the reflection part 330. The second housing 320 may provide heat dissipation function. Accordingly, the first housing 310 coupled to the second housing 320 may receive heat from the second housing 320. As such, if the reflection part 330 directly abuts the inner surface of the first housing 310, the heat of the first housing 310 may be transmitted to the reflection part 330, thereby increasing the temperature of the reflection part 330, which is undesirable. To prevent such a heat conduction, the second sealing part 420 may be disposed between the first housing 310 and the reflection part 330 to prevent the heat of the housing 310 from being transmitted to the reflection part 330. To this end, the second sealing part 420 may include a material exhibiting a relatively low thermal conductivity and may include a heat-resistant material.

Figure 30:
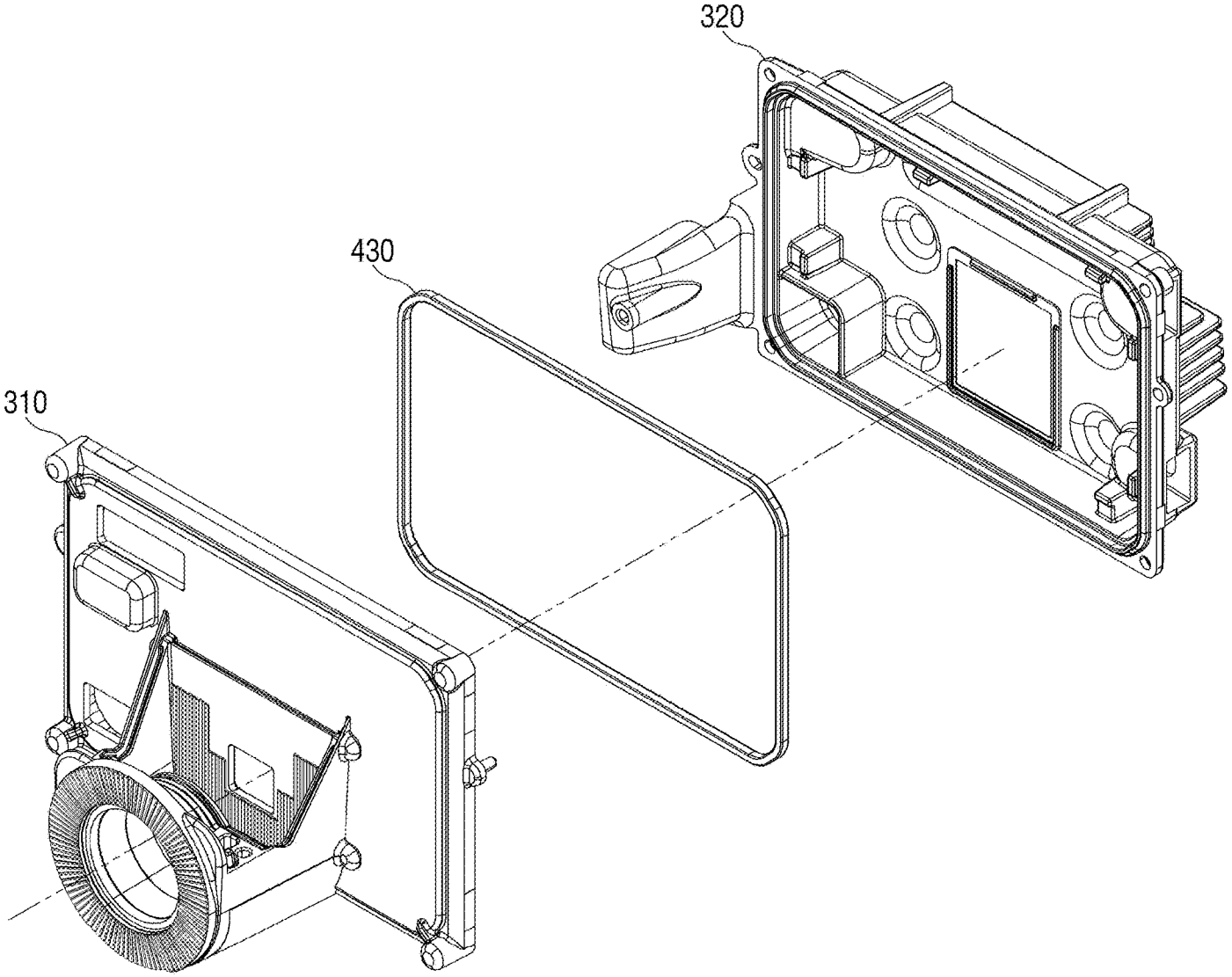
FIG. 30 illustrate the first housing and the second housing coupled to each other according to an embodiment of the present disclosure.

FIG. 30 illustrates the first housing and the second housing being coupled to each other. Referring to FIG. 30, the housings 310 and 320 may include the first housing 310 and the second housing 320 coupled to each other and configured to provide an accommodation space for the reflection part 330.

If the first housing 310 and the second housing 320 do not come in a sufficiently close contact with each other, a gap may occur between the first housing 310 and the second housing 320. If a gap is formed between the first housing 310 and the second housing 320, foreign substances may enter the housing through the gap.

In order to prevent foreign materials, a third sealing part 430 that seals the inside of the housings 310 and 320 may be provided between the first housing 310 and the second housing 320. The third sealing part 430 may be disposed between the first housing 310 and the second housing 320 to seal the inside of the housing. For instance, the third sealing part 430 may include a material exhibiting a relatively high resilience, such as rubber, urethane, or silicone. As the third sealing part 430 seals the gap between the first housing 310 and the second housing 320, foreign substances may be prevented from entering the housings 310 and 320.

Further, at least one of the first housing 310, the second housing 320, or the third sealing portion 430 may obstruct transmission of electromagnetic waves. If the electromagnetic waves are introduced into the housings 310 and 320 from outside, the reflection part 330 may malfunction, and may fail to form the variable beam patterns VP1 and VP2 or may cause a distorted variable beam pattern to be formed. Since at least one of the first housing 310, the second housing 320, or the third sealing part 430 prevents the transmission of the electromagnetic waves, the variable beam patterns VP1 and VP2 may be properly formed.

Although the embodiments of the present disclosure have been described with reference to the above and the accompanying drawings, those of ordinary skill in the art, to which the present disclosure pertains, can understand that the present disclosure may be implemented in other specific forms without changing the technical spirit or essential features. Therefore, it should be understood that the embodiments described above are illustrative only in all aspects and should not be interpreted as limiting in any aspect.

What is claimed is:

1. A lamp for a vehicle comprising a variable beam forming part that irradiates light and forms a variable beam pattern, wherein the variable beam forming part comprises:
- a first optical part that generates the light;
- a beam pattern forming part that reflects the light from the first optical part to form the variable beam pattern; and
- a second optical part that transmits the light reflected from the beam pattern forming part,
- wherein the beam pattern forming part comprises:
  - a reflection part including a plurality of micromirrors; and
  - a housing that accommodates the reflection part,
- wherein the housing comprises:
  - an auxiliary housing to support the second optical part that extends from the housing; and
  - an anti-reflection member that prevents secondary reflection of the light reflected by the reflection part, and
- wherein the anti-reflection member comprises a first light diffusion part formed on an inner bottom surface of the auxiliary housing and configured to diffuse incident light.

2. The lamp for a vehicle of claim 1, wherein the auxiliary housing prevents light that is not incident on the second optical part from being emitted to outside, among the light reflected by the reflection part.

3. The lamp for a vehicle of claim 2, wherein the housing comprises a light transmitting plate sealed by the auxiliary housing and disposed between the reflecting part and the second optical part,
- wherein the light transmitting plate comprises a light transmitting aperture to transmit the light reflected by the reflecting part, and
- wherein the anti-reflection member comprises a second light diffusion part formed on a surface of the light transmitting plate that faces the second optical part to diffuse incident light.

4. The lamp for a vehicle of claim 3, wherein the second light diffusion part comprises semicircular pillar-shaped convex and concave surfaces elongated in a vertical direction.

5. The lamp for a vehicle of claim 3, wherein no second light diffusion part is formed in at least a portion of an edge of the light transmitting aperture on a surface of the light transmitting plate.

6. The lamp for a vehicle of claim 2, wherein the auxiliary housing comprises a light transmitting aperture, to which the second optical part is coupled, to transmit light to be incident on the second optical part, and
- wherein the anti-reflection member includes a third light diffusion part formed on an inner surface of the auxiliary housing adjacent to the light transmitting aperture and configured to diffuse incident light.

7. The lamp for a vehicle of claim 6, wherein the third light diffusion part comprises semicircular pillar-shaped convex and concave surfaces elongated in a vertical direction.

8. The lamp for a vehicle of claim 1, wherein the anti-reflection member absorbs or diffuses incident light.

9. The lamp for a vehicle of claim 1, wherein the first light diffusion part comprises a hemispherical convex surface and a hemispherical concave surface.

* * * * *